US007212767B2

(12) United States Patent
Hosokawa et al.

(10) Patent No.: US 7,212,767 B2
(45) Date of Patent: May 1, 2007

(54) IMAGE FORMING APPARATUS AND PROCESS CARTRIDGE REMOVABLY MOUNTED THERETO

(75) Inventors: Hiroshi Hosokawa, Kanagawa (JP); Kiyonori Tsuda, Kanagawa (JP); Satoshi Narumi, Kanagawa (JP); Ryuta Takeichi, Kanagawa (JP); Yuji Arai, Kanagawa (JP); Masanori Kawasumi, Kanagawa (JP); Kazuhiko Umemura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/636,637

(22) Filed: Aug. 8, 2003

(65) Prior Publication Data

US 2004/0096239 A1 May 20, 2004

(30) Foreign Application Priority Data

Aug. 9, 2002 (JP) ..... 2002-233940
Nov. 20, 2002 (JP) ..... 2002-337187
Nov. 21, 2002 (JP) ..... 2002-338575

(51) Int. Cl.
*G03G 21/16* (2006.01)

(52) U.S. Cl. ..... 399/111

(58) Field of Classification Search ..... 399/111, 399/299, 302, 308

See application file for complete search history.

(56) References Cited

U.S. PATENT DOCUMENTS 5,943,529 A 8/1999 Miyabe et al.
6,163,666 A 12/2000 Hosokawa et al.
6,198,895 B1 3/2001 Tsuda et al.
6,212,343 B1 4/2001 Hosokawa et al.
6,337,957 B1 1/2002 Tamaki et al.
6,363,237 B1 3/2002 Nagame et al.
6,447,973 B1 9/2002 Asami et al.
6,493,529 B1 12/2002 Umemura et al.

(Continued)

FOREIGN PATENT DOCUMENTS

CN 1329289 A 1/2002

(Continued)

OTHER PUBLICATIONS

Patent Abstracts of Japan, JP 2001-249508, Sep. 14, 2001.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus of the present invention includes an apparatus body, an image carrier for carrying a latent image on its surface, and a developing device for developing the latent image to thereby produce a corresponding toner image. A removable member is removably mounted to the apparatus body and positioned in the apparatus body such that a distance between the removable member and a surrounding member around it varies when the removable member is being mounted to or dismounted from the apparatus body. A frame surrounds at least one of the removable member and surrounding member. A contact member contacts, when the removable member is being mounted to or dismounted from the apparatus body, the frame to thereby determine a distance between the removable member and the surrounding member.

28 Claims, 30 Drawing Sheets

U.S. PATENT DOCUMENTS

| | | | | |
|---|---|---|---|---|
| 6,521,386 | B1 | 2/2003 | Sakon et al. | |
| 6,522,855 | B1 | 2/2003 | Katoh et al. | |
| 6,558,862 | B2 | 5/2003 | Kojima et al. | |
| 6,560,431 | B2 | 5/2003 | Hosokawa | |
| 6,562,529 | B1 | 5/2003 | Kojima et al. | |
| 6,615,013 | B2 | 9/2003 | Arai et al. | |
| 2001/0031153 | A1* | 10/2001 | Sameshima et al. | 399/111 |
| 2002/0090228 | A1* | 7/2002 | Takahashi et al. | 399/111 |

FOREIGN PATENT DOCUMENTS

| | | |
|---|---|---|
| EP | 1 162 513 A1 | 12/2001 |
| JP | 59-031976 | 2/1984 |
| JP | 63-125864 | 8/1988 |
| JP | 01-251066 | 10/1989 |
| JP | 02-302766 | 12/1990 |
| JP | 03-211569 | 9/1991 |
| JP | 04-333063 | 11/1992 |
| JP | 6-110261 | 4/1994 |
| JP | 07-132665 | 5/1995 |
| JP | 09-127851 | 5/1997 |
| JP | 11-84985 | 3/1999 |
| JP | 11-295952 | 10/1999 |
| JP | 2000-122433 | 4/2000 |
| JP | 2000-194203 | 7/2000 |
| JP | 2000-321843 | 11/2000 |
| JP | 2002-006588 | 1/2002 |
| JP | 2002-062711 | 2/2002 |

OTHER PUBLICATIONS

Patent Abstracts of Japan, JP 2000-235309, Aug. 29, 2000.
U.S. Appl. No. 11/247,269, filed Oct. 12, 2005, Uchiyama et al.
U.S. Appl. No. 11/287,305, filed Nov. 28, 2005, Hosokawa et al.

* cited by examiner

IMAGE FORMING APPARATUS AND PROCESS CARTRIDGE REMOVABLY MOUNTED THERETO

BACKGROUND OF THE INVENTION

1. Field of the Invention

The present invention relates to a copier, facsimile apparatus, printer or similar image forming apparatus. More particularly, the present invention relates to an image forming apparatus including an image carrier, image forming devices for forming a toner image on the image carrier and an image transferring device for transferring the toner image to a sheet or recording medium, wherein the image carrier and one or more of the image forming devices are constructed into an image forming unit removably mounted to the body of the image forming apparatus.

2. Description of the Background Art

A color image forming apparatus of the type using an intermediate image transfer system belongs to a family of conventional image forming apparatuses. This type of image forming apparatus includes a plurality of photoconductive drums or image carriers and a single intermediate image transfer drum facing the drums. Toner images of different colors are sequentially transferred from the drums to the intermediate image transfer belt one above the other, completing a composite color image. The composite color image is then transferred to a sheet or recording medium.

It is likely that the toner images of different colors are shifted in position from each other on the intermediate image transfer belt, resulting in color shift. Color shift is a serious problem when it comes to a color image forming apparatus. To obviate color shift, it has been customary to accurately mount and affix the intermediate image transfer belt and drums to the apparatus body by use of a jig.

The intermediate image transfer belt whose life is usually shorter than the life of the apparatus body must be replaced when the degradation of performance or damage occurs before the life of the apparatus body ends. A specific conventional method of replacing the intermediate image transfer belt will be described hereinafter.

The intermediate image transfer belt is included in a belt unit, which forms part of an image forming unit, together with rollers over which the belt is passed and a frame surrounding the belt and rollers. When the belt unit is disposed in the apparatus body, axially opposite ends of each roller is accurately positioned. The ends of the rollers may be positioned by a specific configuration to be described hereinafter.

In the specific configuration, parallel pins are studded on opposite ends of each roller in such a manner as to extend in the axial direction of the roller. Guide holes are formed in the rear wall of the apparatus body while an opening is formed in the front wall and sized to allow the belt unit to be mounted or dismounted therethrough. A faceplate, which selectively opens or closes the above opening, is also formed with guide holes. Two arms extend from the bottom of the faceplate and are hinged to the apparatus body via a shaft. The faceplate is therefore angularly movable between a horizontal position parallel to a floor and a vertical position perpendicular to the horizontal position. The faceplate covers the opening in the vertical position or uncovers it in the horizontal position. When the belt unit is mounted to the apparatus body, the pins of the rollers each enter one of the guide holes to thereby accurately position the path of the intermediate image transfer belt inside the apparatus body.

For example, assume that developing devices and photoconductive drums are positioned above the intermediate image transfer belt. Then, to dismount the belt unit from the apparatus body, the faceplate is lowered to the horizontal position to uncover the opening with the guide holes of the faceplate being released from the front pins of the rollers. Subsequently, the belt unit is pulled out toward the front of the apparatus body. At this instant, the rear pins of the rollers are released from the guide holes of the rear wall as soon as the belt unit is slightly pulled out. As a result, the belt unit is made free. The belt unit is then fully pulled out of the apparatus body. To mount the belt unit, the belt unit is inserted into the apparatus body via the opening, which is uncovered then, until the rear pins of the rollers mate with the guide holes of the rear wall. Subsequently, the faceplate is raised toward the vertical position to cover the opening with the guide holes of the faceplate mating with the front pins. The belt unit is fully positioned when the faceplate reaches the vertical position.

The user of the apparatus must bear extra expenses every time the user calls a service person for, e.g., the replacement of the intermediate image transfer belt. It is therefore preferable to construct replaceable members into a single unit that can be replaced by the user.

The problem with the conventional belt unit described above is that the intermediate image transfer belt and drums are apt to contact and rub each other in the event of mounting or dismounting of the belt unit. More specifically, the pins of the rollers all are released from the guide holes as soon as the belt unit is slightly pulled toward the front of the apparatus body, as stated earlier. Therefore, if the belt unit shakes when being pulled out, then it is likely to move upward and contact and rub the drums and other members adjoining the intermediate image transfer belt. Such undesirable contact is apt to occur even when the belt unit is being mounted to the apparatus body. As a result, even a member that does not need replacement is scratched or otherwise damaged and must be wastefully replaced. This is particularly true when the user replaces the belt unit.

In light of the above, a space between the drums and the intermediate image transfer belt may be provided with a margin great enough to prevent the drums and intermediate image transfer belt from contacting each other even when the belt unit shakes during mounting or dismounting. This scheme, however, brings about another problem that the size of the apparatus increases in the direction of height.

The problems stated above arise not only with the intermediate image transfer belt but also with, e.g., a sheet conveying belt included in a belt unit mounted on a color image forming apparatus that uses a direct image transfer system.

Not only the belt unit and drums but also some other members must be prevented from contacting each other without a distance therebetween being increased. For example, when a developing device, facing any one of the drums, is removably mounted on the apparatus body, the developing device should preferably be prevented from contacting the drum. Also, when a cleaning unit, including the drum and a drum cleaner, or a process cartridge, including the drum and developing device, is removably mounted on the apparatus body, the cleaning unit or the process cartridge should preferably be prevented from contacting the drum. This is also true with an image forming unit or similar member removably mounted on the apparatus body and apt to shake and contact members therearound during mounting or dismounting.

To prevent the removable member from contacting members therearound, Japanese Patent Laid-Open Publication No. 9-325622, for example, proposes an image transferring unit angularly movable about a drive shaft between a contact position where it contacts photoconductive drums and a retracted position where the former is released from the latter. This document teaches that by moving the image transferring unit to the retracted position before the replacement of a drum unit, it is possible to prevent the drums and an image transfer belt from contacting each other. This proposal, however, also needs a margin in the distance between the image transferring unit and the drums when shaking to occur during mounting or dismounting is taken into account.

Japanese Patent Laid-Open Publication No. 2000-235309 discloses a belt unit, including an intermediate image transfer belt, removably mounted on an apparatus body and provided with a positioning block. When the belt unit is to be mounted to the apparatus body, the positioning block of the belt unit is positioned on a guide rail, and then the belt unit is inserted into the apparatus body. Subsequently, to set the belt unit in an operable position, a lift cam lifts the positioning block until the block abuts against a positioning shaft mounted on the apparatus body. As a result, the top of the belt and drums are positioned relative to each other. This allows the user of the apparatus to easily replace the intermediate image transfer belt while accurately positioning the drums and belt relative to each other. However, the positioning block is not lifted by the cam during mounting or dismounting of the belt unit, so that a space exists above at least the side of the belt unit where the positioning block is located. Consequently, the belt and drums are apt to contact each other when the user inadvertently lifts the belt unit during replacement of the belt.

Further, Japanese Patent Laid-Open Publication No. 2001-249508 teaches an image forming unit removably mounted on an apparatus body and made up of a photoconductive drum unit and an intermediate image transferring unit. Guide rails for a photoconductive drum and guide rails for an intermediate image transfer belt are arranged in the apparatus body. To mount or dismount the image forming unit to or from the apparatus body, drum bearings included in the image forming unit are positioned on the drum guide rails. At the same time, bearings mounted on opposite ends of a drive roller, which drives the intermediate image transfer belt, and lugs protruding from opposite side covers of the image forming unit are positioned on the belt guide rails. Subsequently, the image forming unit is slid into or out of the apparatus body. This configuration, however, is apt to bring about shaking because the image forming unit is slid with the bearings or the lugs contacting the guide rails, causing the image forming unit to contact members arranged in the apparatus body.

Technologies relating to the present invention are also disclosed in, e.g., Japanese Patent Laid-Open Publication Nos. 6-110261, 11-84985, 11-295952 and 2000-194203.

SUMMARY OF THE INVENTION

It is an object of the present invention to provide an image forming apparatus capable of reducing the size and extending the life of an image forming apparatus on which an image forming unit or similar removable member is mounted.

It is another object of the present invention to provide an image forming apparatus capable of preventing, when an image forming unit or similar removable member is mounted to or dismounted from the apparatus body, the image forming unit from hitting against an image transferring device or preventing, when a plurality of image forming units are arranged side by side, the image forming units from hitting against each other.

It is a further object of the present invention to provide a process cartridge or removable member removably mounted on one of the above image forming apparatuses.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, reference will be made to the conventional arrangement in which the distance between the photoconductive drums and the intermediate image transfer belt is provided with a margin great enough to prevent them from contacting even when the belt unit shakes during mounting or dismounting.

Figure 1:
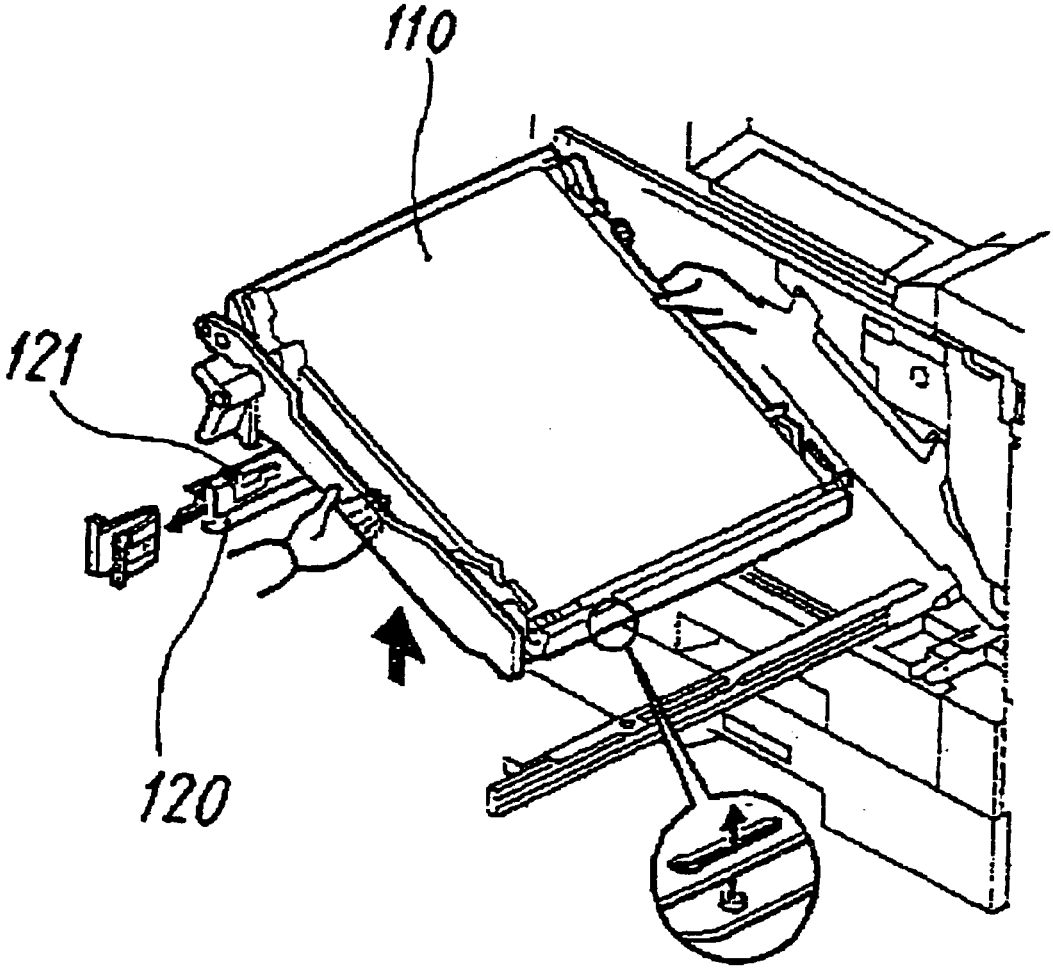
FIG. 1 PRIOR ART
FIG. 1 demonstrates how a conventional belt unit is mounted to or dismounted from an image forming apparatus.

As shown in FIG. 1, the bottom of a belt unit 110 is mounted on slide rails 120 at opposite ends. The slide rails 120 each are formed with a channel 121 receiving a pin, not shown, studded on the belt unit 110. The channel 121 is higher at the rear side than at the front side and formed throughout the top of the guide rail 120 at the front side, as illustrated. The slide rails 120 are supported by the apparatus body in such a manner as to be slidable toward the front.

When the belt unit 110 is pulled out toward the front, the belt unit 110 moves toward the front relative to the slide rails 120 while moving downward by a difference in the height of each channel 121. When the belt unit 110 is further moved toward the front with the pins sliding in the channels 121, a sufficient space exists between the intermediate image transfer belt and photoconductive drums positioned above the belt. Subsequently, when the pins reach the front ends of the channels 121, the belt unit 110 stop moving relative to the slide rails 120, so that the belt unit 110 and slide rails 120 are brought out of the apparatus body. The belt unit 110 is slidable by more than the entire length thereof, so that it can be fully exposed to the outside.

In the above condition, when the operator lifts the belt unit 110, the pins of the belt unit 110 are released from the slide rails 120 via the notches of the channels 121, allowing the belt unit 110 to be fully removed from the apparatus body.

To mount the belt unit 110 to the apparatus body, the operator inserts the pins of the belt unit 110 into the channels 121 of the slide rails 120 until the belt unit 110 has been retained by the slide rails 120. When the belt unit 110 is being inserted into the apparatus body, the belt unit 110 is supported by the lower portions of the slide rails 120, so that a sufficient space exists between the belt unit 110 and the drums. The belt unit 110 stops sliding relative to the slide rails 120 when reached the deepest portions of the channels 121. As a result, the belt unit 110 and slide rails 120 integrally move deeper into the apparatus body. As soon as the slide rails 120 reach the deepest position, the pins of the belt unit 110 are supported by the higher portions of the channels 121, causing the belt unit 110 to bodily rise. In this manner, the belt unit 110 is positioned inside the apparatus body.

In the above configuration, the belt unit 110 is prevented from unexpectedly rising and contacting the drums during mounting or dismounting. The belt unit 110 is lowered along the channels 121 of the slide rails 120 during mounting or dismounting in order to guarantee the sufficient space between the belt unit 110 and the drums. This, however, makes it necessary to increase the distance between the drums and the intermediate image transfer belt by taking account of shaking to occur during mounting or dismounting, resulting an increase in the size of the apparatus body in the direction of height.

Preferred embodiments of the present invention will be described hereinafter. It is to be noted that the reference numerals used in each embodiment are independent of the reference numerals of the other embodiments, i.e., the same reference numerals do not always designate the same structural elements.

First Embodiment

A first embodiment of the image forming apparatus in accordance with the present invention, implemented as a color printer by way of example, will be described hereinafter with reference to FIG. 2. As shown, the color printer includes four image stations 1Y (yellow), 1C (cyan), 1M (magenta) and 1Bk (black) respectively assigned to colors represented by Y through Bk. Members included in the image stations 1Y through 1Bk are also distinguished from each other by suffixes Y through Bk. The color printer additionally includes an optical writing unit 8, an intermediate image transferring unit 10, a bias roller 5 for secondary image transfer, a registration roller pair 4, a sheet cassette 2, and a fixing unit 6.

The optical writing unit 8 includes lasers or light sources, a polygonal mirror, an fθ lens and mirrors. The writing unit 8 scans the surface of each photoconductive drum or image carrier, which will be described later, with a laser beam in accordance with image data.

Figure 3:
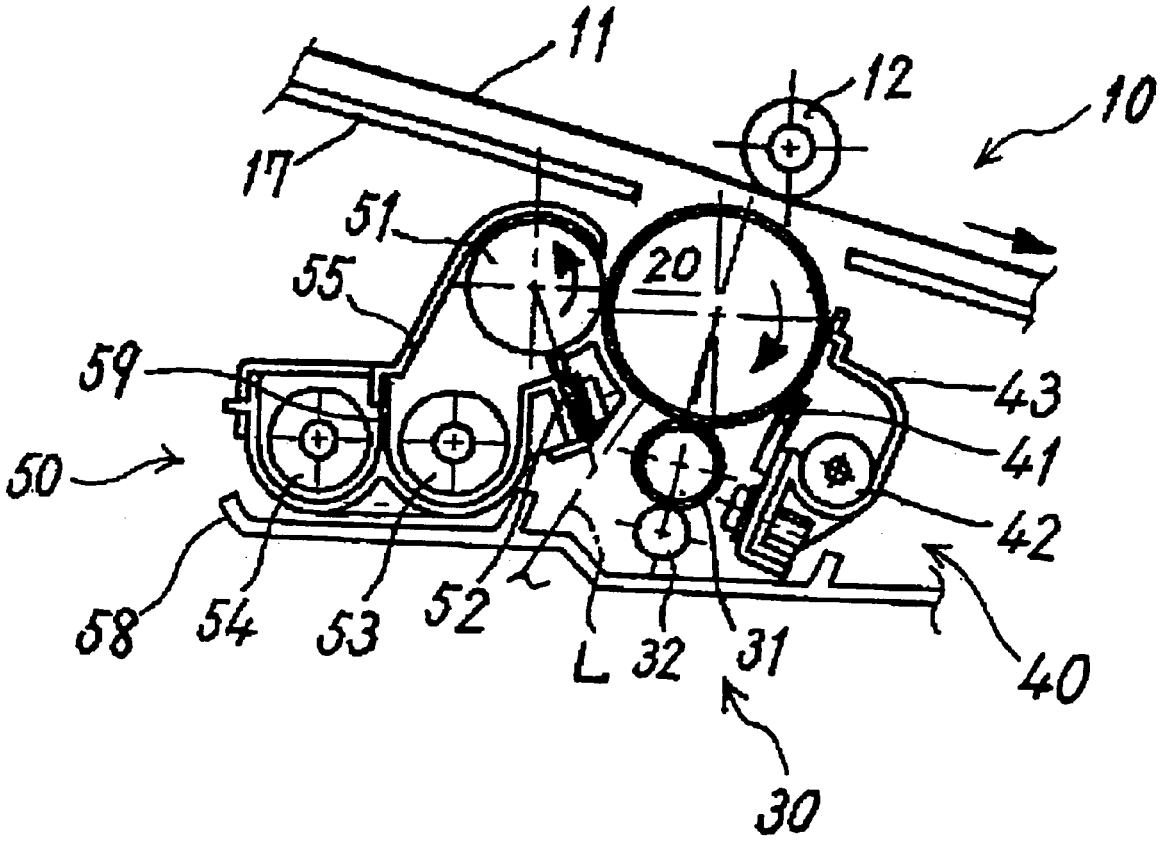
FIG. 3 is an enlarged view showing one of a plurality of image stations included in the illustrative embodiment.

The image stations 1Y through 1Bk are identical in configuration except for color. FIG. 3 shows the configuration of one of the image station 1Y through 1Bk specifically. As shown, the image station includes a photoconductive drum or image carrier 20, a charger 30, a developing unit 50, a drum cleaner or drum cleaning device 40, and a quenching lamp or discharger not shown.

The charger 30 uniformly charges the surface of the drum 20 with a charge roller 31, applied with a bias voltage, contacting the drum 20. The optical writing unit 8, FIG. 1, scans the charged surface of the drum 20 with a laser beam L in accordance with image data, thereby forming a latent image. The developing unit 50 develops the latent image with toner to thereby produce a corresponding toner image. A cleaning roller 32 is held in contact with the charge roller 31.

The drum cleaner 40 includes a case or frame 43 formed with an opening, a cleaning blade 41 for cleaning the drum 20, and a screw 42 for conveying toner removed from the drum 20 by the cleaning blade 41 to a waste toner bottle not shown.

The developing unit 50 includes a casing or frame 55 and a developing roller 51 partly exposed to the outside via an opening, which is formed in the case 55. A first and a second screw 53 and 54 and a doctor 52 are also disposed in the casing 55. A single support plate 58 supports the bottoms of the cases 55 of four developing devices 50, which are included in the image stations 1Y through 1Bk, while being formed with openings for allowing laser beams from the optical writing unit 8 to pass therethrough.

The case 55 stores a two-ingredient developer made up of magnetic carrier grains and toner grains chargeable to negative polarity. The developer is conveyed by the first and second screws 53 and 54 while being agitated thereby by friction and then deposited on the surface of the developing roller 51. The developing roller 51 in rotation conveys the developer to a developing zone where the developing roller 51 and drum 20 face each other via a preselected gap. At this instant, the doctor 52 causes the developer to form a thin layer on the developing roller 51. In the developing zone, the toner included in the developer is transferred from the developing roller 51 to a latent image formed on the drum 20, thereby producing a toner image. The developer thus released toner is returned to the case 55 by the developing roller 51.

A partition 59 is positioned between the first and second screws 53 and 54 so as to divided the inside of the case 55 into a first chamber accommodating the developing roller 51 and first screw 53 and a second chamber accommodating the second screw 54. The first screw 53 is driven by drive means, not shown, to feed the developer present in the first chamber to the developing roller 51 while conveying it from the front toward the rear, as seen in a direction perpendicular to the sheet surface of FIG. 3.

The developer, conveyed by the first screw 53 to the end portion of the first chamber, is introduced into the second chamber via an opening formed in the partition 59. In the second chamber, the second screw 54, driven by drive means not shown, conveys the developer in the opposite direction to the first screw 53, i.e., from the rear toward the front in the above direction. Subsequently, the developer is returned from the second chamber to the first chamber via another opening formed in the partition 59.

The toner image formed on the drum 20 is transferred to an intermediate image transfer belt, which will be described later. After such intermediate image transfer, the drum cleaner 40 removes toner left on the drum 20. Further, the quenching lamp mentioned earlier discharges the surface of the drum 20 thus cleaned to thereby prepare the drum 20 for the next image forming cycle.

Referring again to FIG. 2, the intermediate image transferring unit 10 includes an intermediate image transfer belt (simply belt hereinafter) 11, a belt cleaner or belt cleaning device 16 and four bias rollers 12Y through 12Bk as well as a drive roller 13 and driven rollers 14 and 15 over which the belt 11 is passed under preselected tension. The belt 11, belt cleaner 16 and other various members are supported by a single case or frame 17. The drive roller 13, driven by a driveline not shown, causes the belt 11 to move counterclockwise as viewed in FIG. 2.

A particular power supply, not shown, applies a bias for intermediate image transfer to each of the bias roller 12Y through 12Bk. The bias rollers 12Y through 12Bk press the belt 11 against the drums 20Y through 20Bk, respectively, at the inside of the loop of the belt 11, thereby forming nips for intermediate image transfer. An electric field is formed between each drum 20 and corresponding one of the bias rollers 12Y through 12Bk by the above bias.

A toner image formed on the drum 20Y, i.e., a Y toner image is transferred from the drum 20Y to the belt 11 by the above electric field and nip pressure. Subsequently, a C, an M and a Bk toner image formed on the drums 20C, 20M and 20Bk, respectively, are sequentially transferred to the belt 11 over the Y toner image, completing a four- or full-color image on the belt 11. The full-color image is then transferred from the belt 11 to a sheet or recording medium P at a nip for secondary image transfer to be described later. The belt cleaner 16, contacting pat of the belt 11 backed up by the roller 14, removes toner left on the belt 11 after the secondary image transfer.

The sheet cassette 2, positioned below the optical writing unit 8, is loaded with a stack of sheets P while a pickup roller 2*a* is pressed against the top sheet P. When the pickup roller 2*a* is driven at preselected timing, it pays out the top sheet P toward a conveyance path.

The bias roller 5 for secondary image transfer is pressed against the drive roller 13 via the belt 11, forming a nip for secondary image transfer. A power supply, not shown, applies a bias for secondary image transfer to the bias roller 5.

The registration roller pair 4 once stops the leading edge of the sheet P fed from the sheet cassette 2 and then starts conveying it at preselected timing such that the leading edge of the sheet P meets the leading edge of the full-color toner image carried on the belt 11 at the nip for secondary image transfer. At the above nip, the toner image is transferred from the belt 11 to the sheet P by the bias and nip pressure (secondary image transfer). The sheet P, carrying the toner image thereon, is conveyed to the fixing unit 6.

The fixing unit 6 includes a heat roller 6*a* accommodating a heat source therein and a press roller 6*b* pressed against the heat roller 6*a*. The press roller 6*a* and heat roller 6*b* fixed the toner image on the sheet P with heat and pressure while conveying the sheet P. The sheet or print P, coming out of the fixing unit 6 is driven out of the printer by an outlet roller pair 7.

Figure 2:
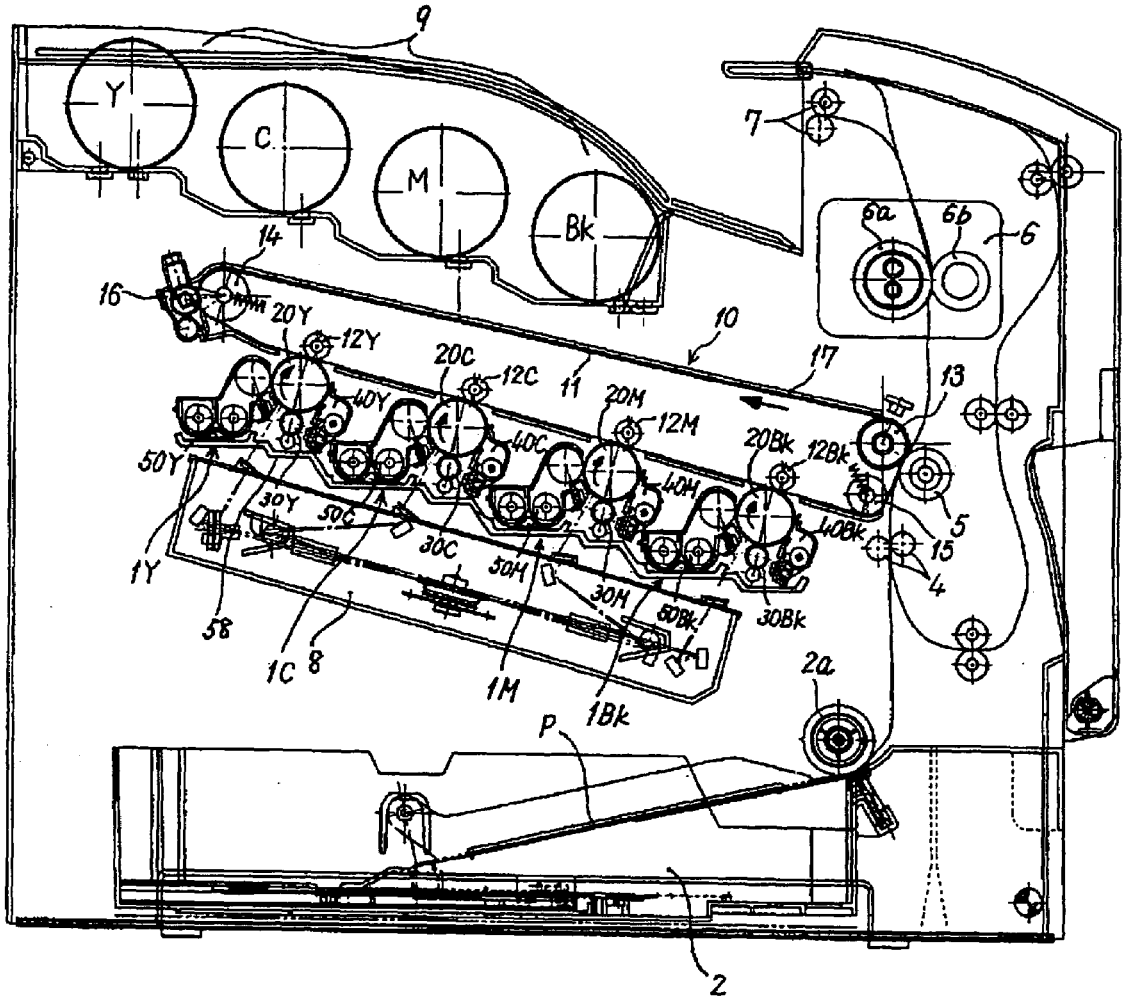
FIG. 2 shows a first embodiment of the image forming apparatus in accordance with the prevent invention.

Four toner containers 9Y through 9Bk are arranged at the left-hand side of the fixing unit 6, as viewed in FIG. 2, and each stores fresh Y, C, M or Bk toner to be suitably replenished to associated one of the developing units 50.

FIG. 3 shows a specific condition wherein the belt 11 is held in contact with the drums 20Y through 20Bk of all the image stations in order to produce a full-color image described above. The illustrative embodiment includes a mechanism for varying the condition wherein the belt 11 contacts the drums 20Y through 20Bk, as will be described hereinafter.

Figure 4:
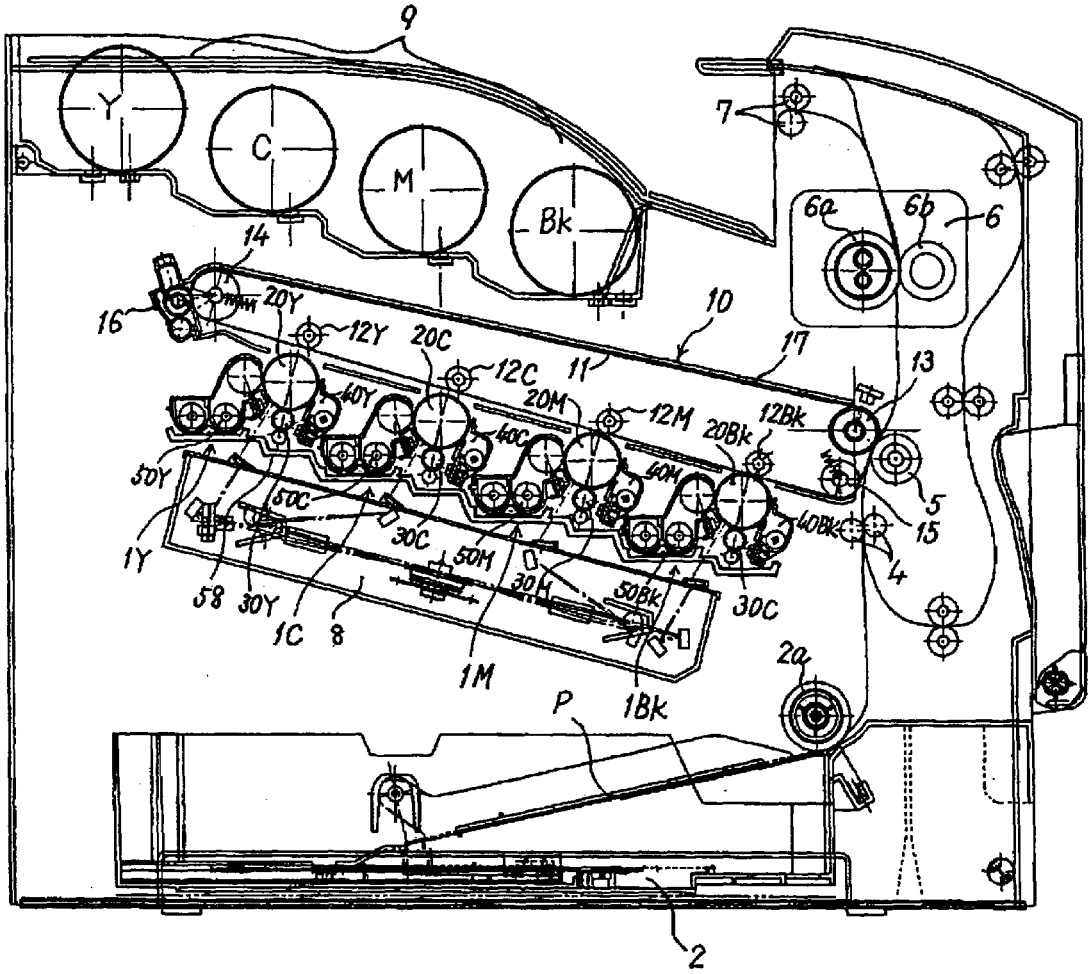
FIG. 4 shows how photoconductive drums and an intermediate image transfer belt contact each other in the illustrative embodiment.

FIG. 4 shows another specific condition wherein only the drum 20 Bk is held in contact with the belt 11 in order to produce a black-and-white toner image. Usually, in the initial condition of the printer and in a black-and-white mode, the belt 11 is held in contact only with the drum 20Bk. In FIG. 4, the belt 11 is shown in a mount/dismount position at which the intermediate image transferring unit 10 or a unit around the belt 11 can be mounted to or dismounted from the printer body. When such a unit should be mounted to or dismounted from the printer body, the drums 20Y through 20Bk all are released from the belt 11.

Figure 6A:
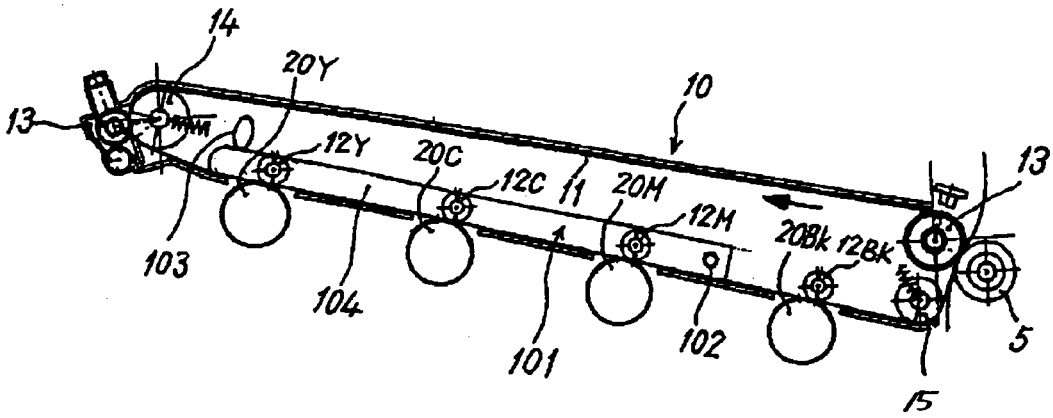
FIGS. 6A, 6B and 6C respectively show an intermediate image transferring unit included in the illustrative embodiment in a full-color mode position, a black-and-white mode position, and a mount/dismount position.

More specifically, FIG. 6A shows the full-color mode position of the intermediate image transferring unit 10. As shown, the intermediate image transferring unit 10 includes a subunit 102 angularly movable about a shaft 102. An eccentric cam 103 is mounted on the unit body of the image transferring unit 10 in order to angularly move the subunit 101. More specifically, the eccentric cam 103 is held in contact with the top of one end of a movable member 104, which is included in the subunit 101, and operatively connected to a motor not shown. A release lever, not shown, is connected to the drive roller 13 and driven roller 15, so that the operator can raise or lower the image transferring unit 10 by hand.

In the full-color mode position shown in FIG. 6A, the eccentric cam 103 presses the movable member 104 of the subunit 101 downward, maintaining the belt 11 in contact with the drums 20Y, 20M and 20C.

Figure 6B:
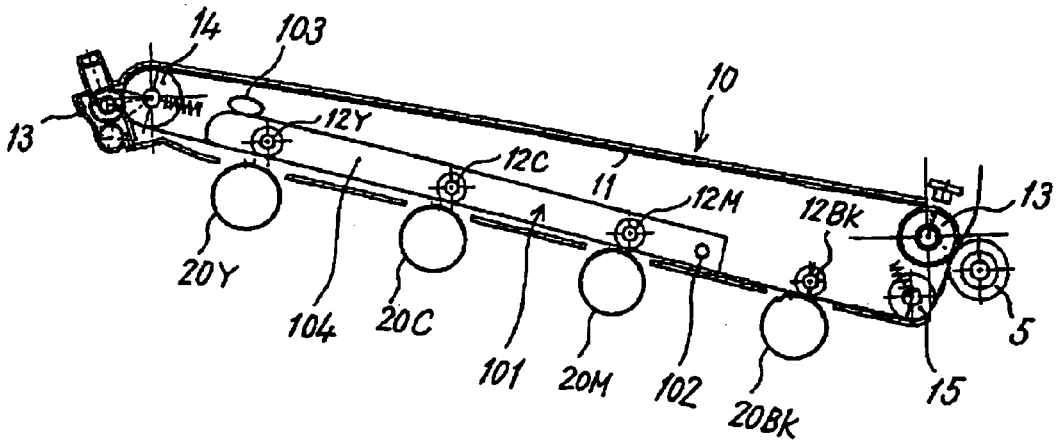

FIG. 6B shows the black-and-white mode position of the intermediate image transferring unit 10. As shown, the eccentric cam 103 is positioned such that the movable member 104 rises and maintains the belt 11 released from the drums 20Y, 20M and 20C.

Figure 5:
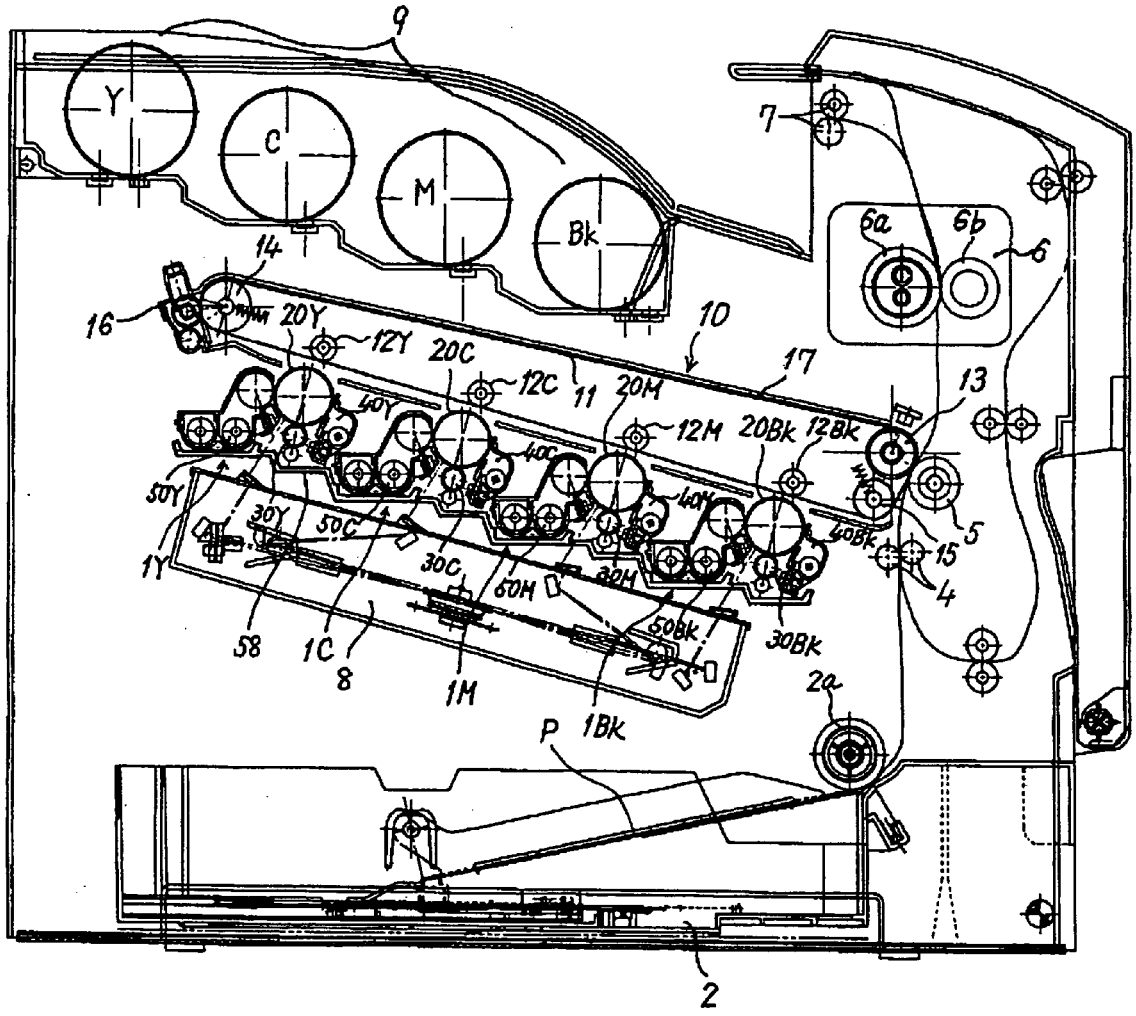
FIG. 5 shows a condition wherein an image forming unit included in the illustrative embodiment is mounted or dismounted.
Figure 6C:
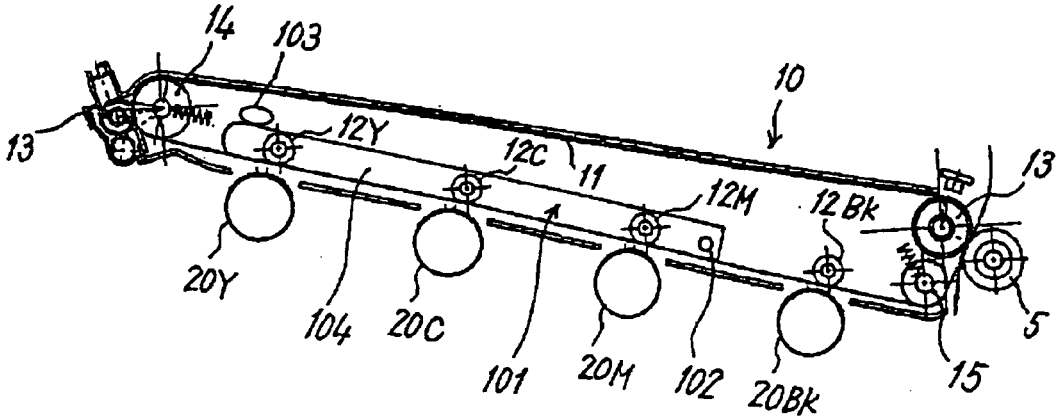

Further, as shown in FIG. 6C, to move the intermediate image transferring unit 10 to the mount/dismount position, the operator turns the previously mentioned lever in the condition or initial condition shown in FIG. 6B, thereby raising the drive roller 13 and driven roller 15. As a result, the intermediate image transferring unit 10 is bodily raised to release the drums 20Y through 20Bk from the belt 11, as shown in FIG. 5.

Some conventional printers each include a member removably mounted to the printer body and arranged such that the distance between the member and any member surrounding it varies when the former is mounted or dismounted. For example, an intermediate image transfer member, including the belt 11 and other members, is removably mounted to a printer body and positioned such that distances between the unit and surrounding members, including drums and a developing case, are apt to vary.

In the conventional construction stated earlier, when the intermediate image transferring unit 10 is mounted or dismounted, the front and rear sides of the belt 11 are unlocked, so that the entire unit 10 becomes free. As a result, the belt is apt to contact drums and frame of a developing unit due to the shaking of the image transferring unit 10, deteriorating the belt and drums. Although the conventional configuration described with reference to FIG. 1 protects the above members from deterioration ascribable to shaking, lower unit support rails must be provided with a margin in the up-and-down direction that takes account of play, increasing the size of the apparatus in the direction of height.

Examples 1 through 8 of the illustrative embodiment, which obviate deterioration and bulky configuration stated above, will be described hereinafter.

EXAMPLE 1

Figure 7:
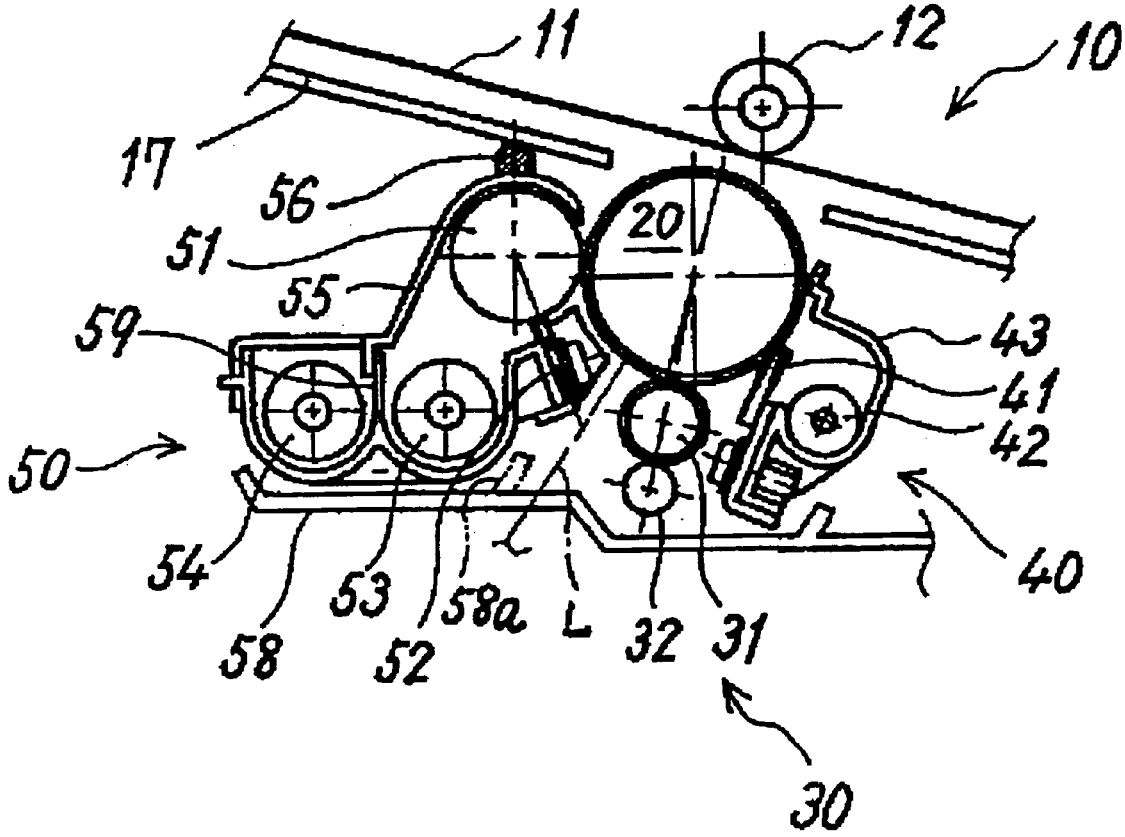
FIG. 7 shows Example 1 of the illustrative embodiment.

FIG. 7 shows part of Example 1 where one of the four image stations 1Y through 1Bk and belt 11 face each other. As shown, a contact member 56 protrudes upward from part of the case 55 of the developing unit 50 facing the case 17 of the intermediate image transferring unit 10. The upper end of the contact member 56 contacts the bottom of the case 17.

A procedure for mounting or dismounting the intermediate image transferring unit 10 to or from the printer body in order to, e.g., replace the belt 11 will be described hereinafter. First, the operator opens a door, not shown, hinged to the front end of the printer body and then opens a faceplate 71, see FIGS. 8A and 8B. Subsequently, the operator turns the release lever to raise the driven roller 15 and drive roller 13, so that the belt 11 is shifted to the mounting/dismounting position shown in FIG. 6C. The operator then pulls out the intermediate image transferring unit 10 by holding it with both hands. The operator can mount the intermediate image transferring unit 10 to the printer body by performing the above procedure in the reverse order.

When the intermediate image transferring unit 10 is being pulled out, as stated above, the case 17 contacts the contact members 56 positioned on the cases 55 of the four developing devices 50 and is prevented from moving downward thereby. Consequently, the belt 11 and drums 20 are maintained released from each other until the intermediate image transferring unit 10 has been fully pulled out of the printer body. This is also true when the above unit 10 is being mounted to the printer body.

In Example 1, not only the intermediate image transferring unit 10 but also the four developing devices 50Y through 50Bk each can be mounted to or dismounted from the printer body, as will be described hereinafter.

Figure 8A:
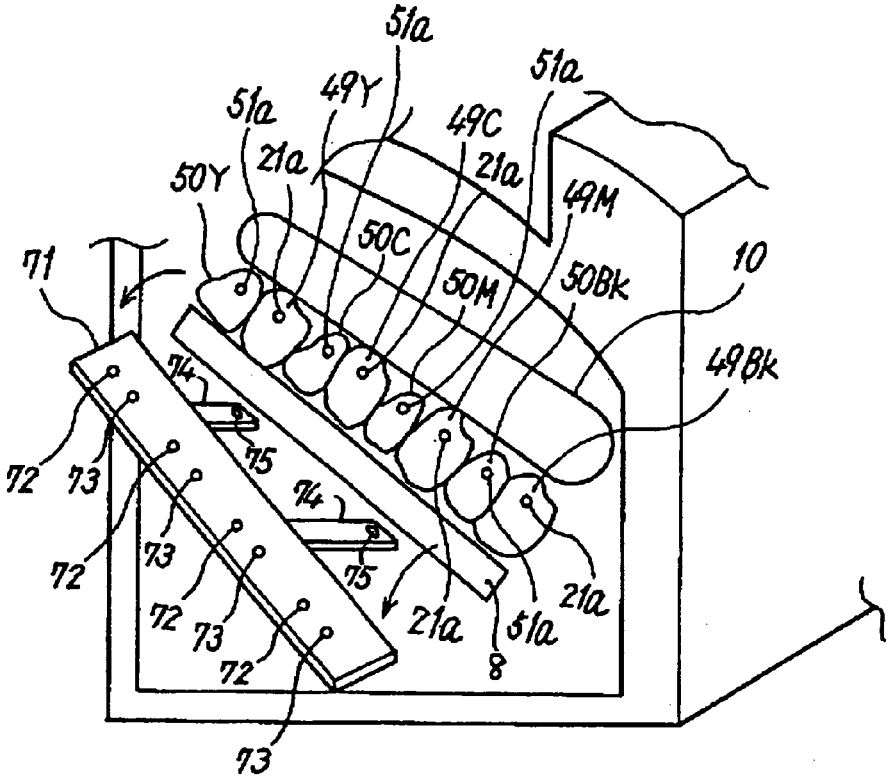
FIGS. 8A and 8B show a structure for positioning a developing unit.

First, reference will be made FIGS. 8A and 8B for describing a structure for positioning the developing devices 50Y through 50Bk in the printer body. As shown, the developing devices 50Y through 50Bk and cleaning devices 49Y through 49Bk each have a developing roller shaft 51*a* or a drum shaft 20*a* protruding toward the front and rear.

The faceplate or positioning member 71 mentioned earlier is exposed to the outside when the operator opens the front door of the printer body. Two arms 74 protrude from the faceplate 71 downward and are mounted on the printer body such that the arms 74 are angularly movable about shafts 75. In this configuration, the faceplate 71 is angularly movable between a closed position where it covers the front ends of the developing devices 50Y through 50Bk and those of the cleaning devices 49Y through 49Bk and an open position where the former uncovers the latter. More specifically, the faceplate 71 is lowered to a substantially horizontal position by hand when uncovering the front end of the printer body or lifted to a substantially vertical position when covering the same.

Four guide holes 72 for the developing devices and four guide holes 73 for the cleaning devices are formed in the faceplate 71 as well as in the rear wall of the printer body, guiding the developing roller shafts 51*a* and drum shafts 20*a*, respectively. The end portions of the shafts 51*a* and 20*a* are tapered each while the guide holes 72 and 73 are sequentially reduced in size toward the deepest position each. When the operator closes the faceplate 71 after mounting the developing devices 50Y through 50Bk to the printer body, the tips of the developing roller shafts 51*a* and those of the drum shafts 20*a* are inserted into the guide holes 71 and 73, respectively. When the above tips reach the deepest positions of the guide holes 71 and 73, they are slightly raised in accordance with the configuration of the inner walls of the guide holes 72 and 73, accurately positioning the developing devices 50Y through 50Bk and cleaning devices 49Y through 49Bk.

Figure 8B:
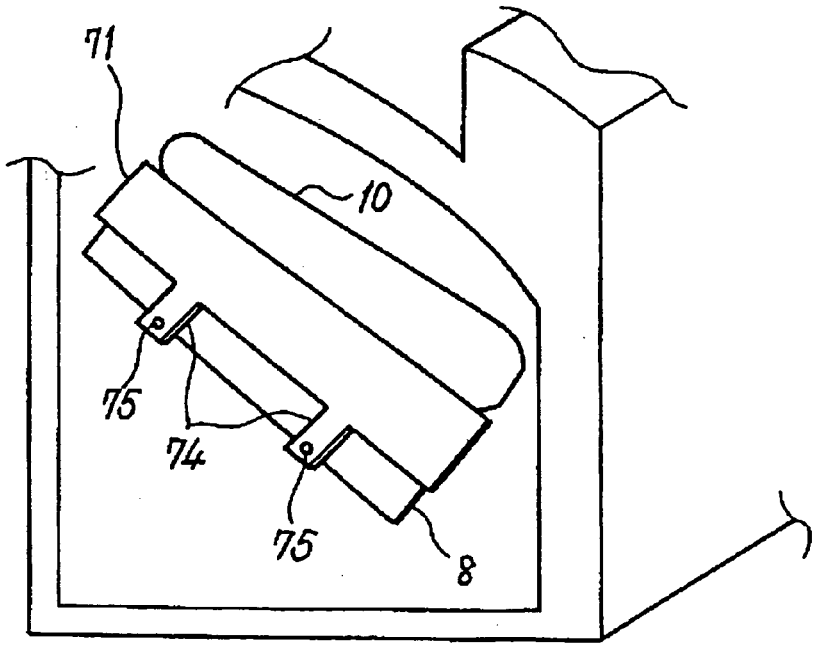

FIG. 8B shows a condition wherein the faceplate 71 is exposed to the outside when the operator has opened the front door in order to pull out the developing devices 50Y through 50Bk. In this condition, the operator angularly moves the faceplate 71 downward to the position shown in FIG. 8A. As a result, the tips of the developing roller shafts 51*a* are released from the guide holes 72 and made free. The operator then holds desired one of the developing devices 50Y through 50Bk and pulls it out of the printer body. As soon as the developing unit 50 is slightly pulled out, the other end of the developing roller shaft 51*a* is released from the guide holes 72. In addition, the bottom of the case 55 of the developing unit 50 is supported by the case 58 and prevented from moving downward thereby. Further, the contact member 56, positioned on the top of the case 55, contacts the bottom of the case 17 of the intermediate image transferring unit 10 for thereby preventing the developing unit 50 from moving upward. The developing unit 50 can therefore be pulled out while being spaced from the intermediate image transferring unit 10 by a preselected distance.

When the operator, intending to mount the developing unit 50 to the printer body, inserts the device 50 deeper into the printer body, the rear end of the developing roller shaft 51*a* mates with the guide hole 72, positioning the developing device at the rear side. Subsequently, when the operator closes the faceplate 71 by lifting it, the front end of the developing roller shaft 51*a* mates with the guide hole 72 formed in the faceplate 71. At the same time as the faceplate 71 is fully brought to the closed or vertical position, the developing unit 50 is fully positioned relative to the printer body. The developing unit 50 thus mounted to the printer body is accurately positioned relative to the members around it.

As shown in FIG. 7, the support case 58 may be formed with a rib 58*a,* indicated by a dash-and-dots line, so as to prevent the developing unit 50 from moving in the right-and-left direction. This is also successful to prevent the gap between the developing roller and the drum 20 from varying when the developing unit 50 is mounted or dismounted.

EXAMPLE 2

Figure 9A:
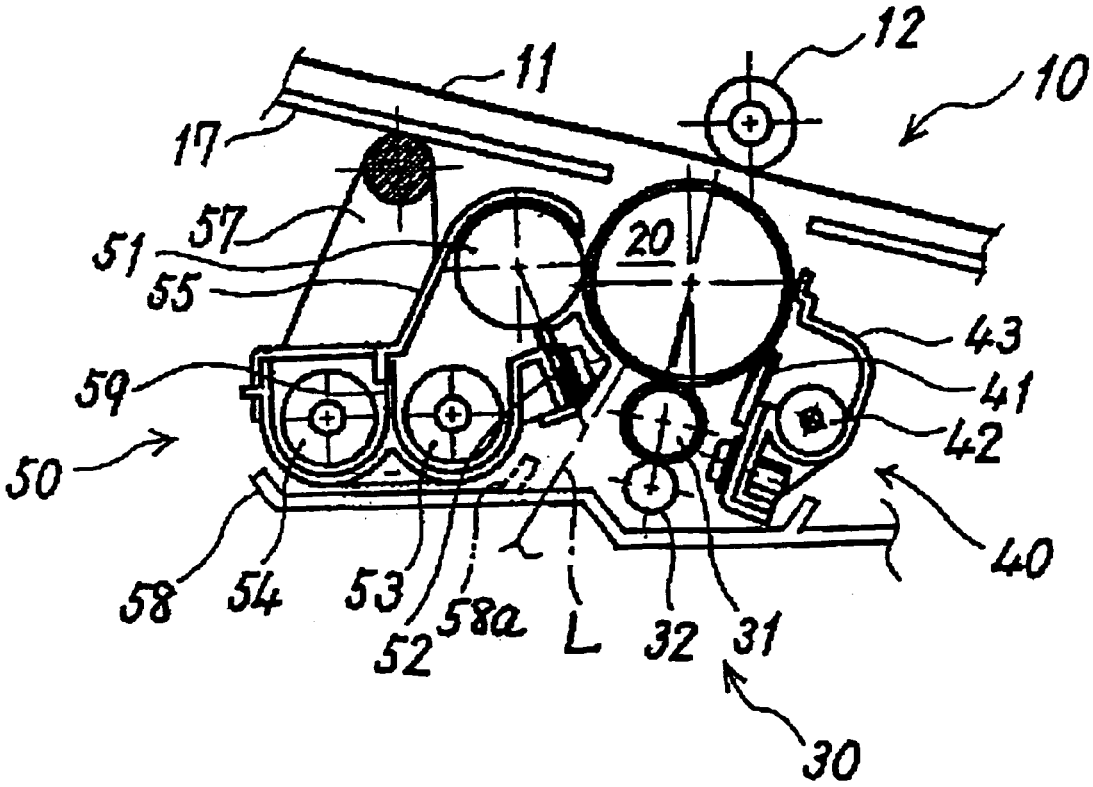
FIG. 9A shows Example 2 of the illustrative embodiment.

FIG. 9A shows Example 2 of the illustrative embodiment, particularly one of the image stations 1Y through 1Bk and belt 11 facing each other. As shown, a grip 57 protrudes upward from part of the developing unit 50 facing the case 17 of the intermediate image transferring unit 10. The top of the grip 57 abuts against the bottom of the case 17.

Figure 9B:
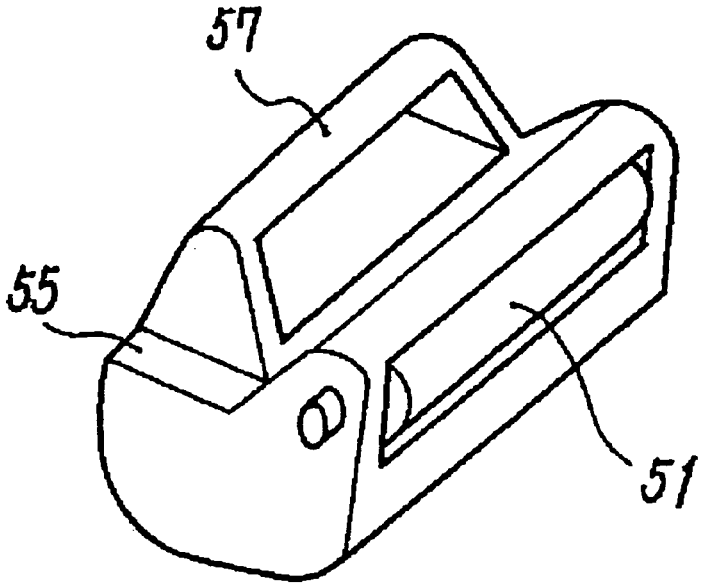
FIG. 9B is an isometric view of a grip included in Example 2.

As shown in FIG. 9B specifically, the grip 57 is configured such that when the developing unit 50 is not mounted to the printer body, the operator can lift it by holding the grip 57. When the developing unit 50 is present on the printer body, the top of the grip 57 contacts the bottom of the case 17 to thereby maintain the developing unit 50 and intermediate image transferring unit 10 spaced from each other by the preselected gap. In this sense, the grip 57 plays the role of a contact member. As for the rest of the configuration and mounting/dismounting procedure, Example 2 is identical with Example 1.

EXAMPLE 3

Figure 10:
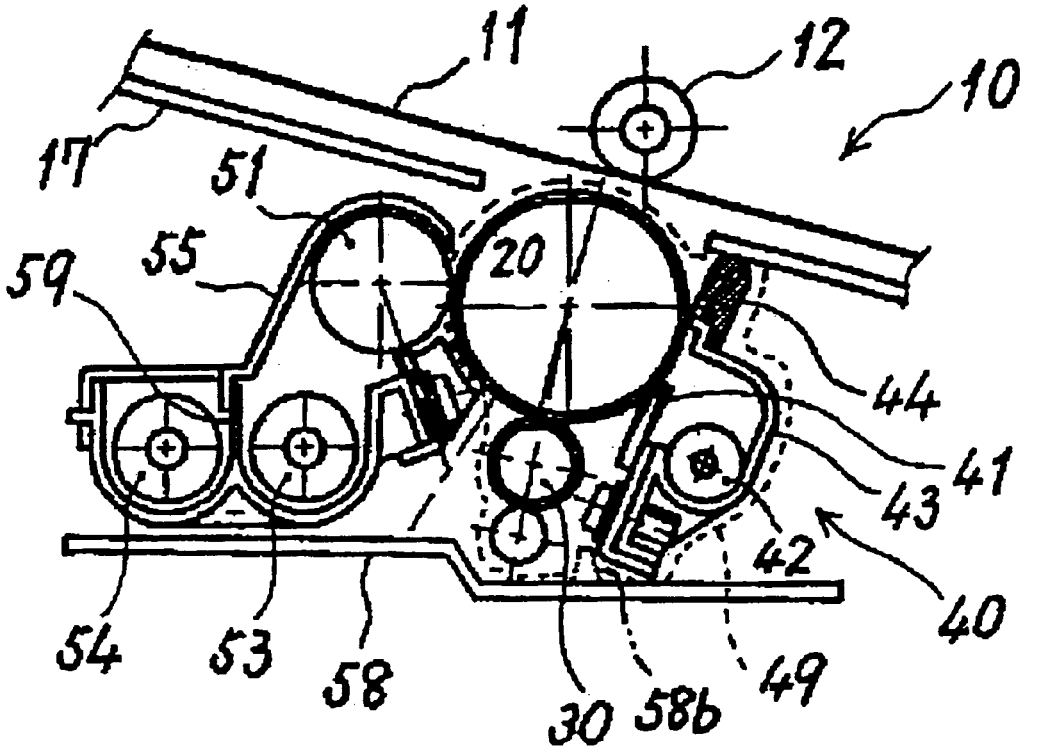
FIG. 10 shows Example 3 of the illustrative embodiment.

FIG. 10 shows Example 3 of the illustrative embodiment, particularly one of the image stations 1Y through 1Bk and belt 11 facing each other. As shown, a contact member 44 protrudes upward from part of the case 43 of the drum cleaner or drum cleaning device 40 facing the case 17 of the intermediate image transferring unit 10. The top of the contact member 44 contacts the bottom of the case 17.

To dismount the intermediate image transferring unit 10 from the printer body in order to, e.g., replace the belt 11, the operator opens the front door, holds the unit 10 with both hands and then pulls it out of the printer body as in Example 1. When the image transferring unit 10 is being so pulled out, the case 17 is held in contact with the contact member 44 and prevented from moving downward thereby. The image transferring unit 10 can be released from the printer body when fully pulled out as in Example 1. The operator can mount the intermediate image transferring unit 10 to the printer body by performing the above procedure in the reverse order.

In Example 3, not only the intermediate image transferring unit 10 but also the cleaning unit 49, made up of the drum 20 and drum cleaner, can be mounted to or dismounted from the printer body. To pull out the cleaning unit 49, the operator opens the front door, holds the cleaning unit 49 and then pulls it out. At this instant, the case 43 of the cleaning device is supported by the support case 58 and prevented from moving downward thereby. In addition, the contact member 44 positioned on the cleaning case 43 contacts the case 17 to thereby prevent the cleaning unit 49 from moving upward. This successfully maintains the gap between the intermediate image transferring unit 10 and the cleaning unit 49 constant. The operator can mount the cleaning unit 49 to the printer body by performing the above procedure in the reverse order.

As shown in FIG. 7, the support case 58 may be formed with a rib 58*b,* indicated by a dash-and-dots line in FIG. 7, so as to prevent the cleaning unit 49 from moving in the right-and-left direction. This is also successful to prevent the gap between the developing roller and the drum 20 from varying when the cleaning unit 49 is mounted or dismounted.

EXAMPLE 4

Figure 11A:
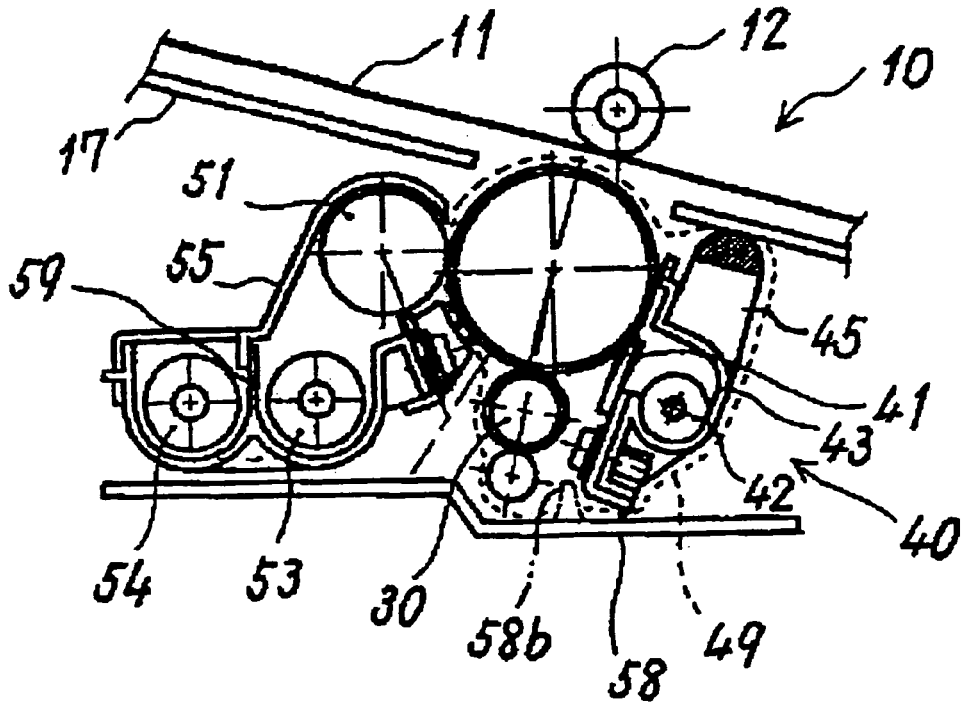
FIG. 11A shows Example 4 of the illustrative embodiment.

FIG. 11A shows Example 4 of the illustrative embodiment, particularly one of the image stations 1Y through 1Bk and belt 11 facing each other. As shown, a grip 45 protrudes upward from part of the case 43 of the cleaning unit 49 facing the case 17 of the intermediate image transferring unit 10. The top of the grip 45 abuts against the bottom of the case 17.

Figure 11B:
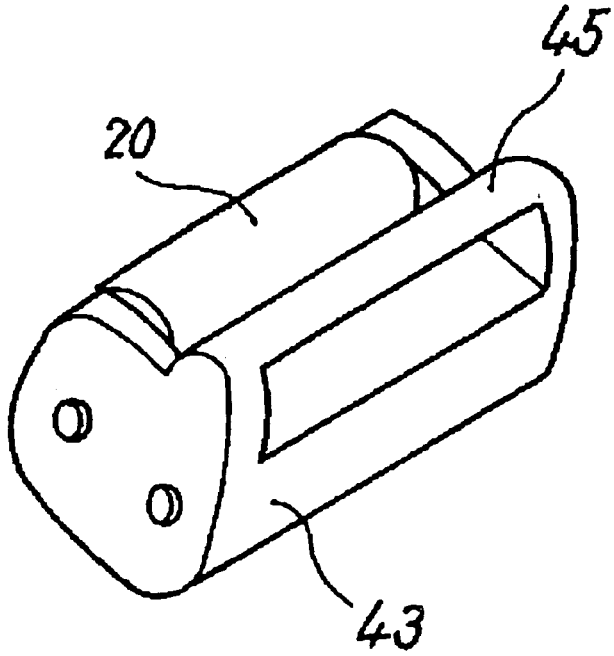
FIG. 11B is an isometric view showing a grip included in Example 4.

As shown in FIG. 11B specifically, the grip 45 is configured such that when the cleaning unit 49 is not mounted to the printer body, the operator can lift it by holding the grip 45. When the cleaning unit 49 is present on the printer body, the top of the grip 45 contacts the bottom of the case 17 to thereby maintain the cleaning unit 49 and intermediate image transferring unit 10 spaced from each other by the preselected gap. In this sense, the grip 45 also plays the role of a contact member. As for the rest of the configuration and mounting/dismounting procedure, Example 4 is identical with Example 4.

EXAMPLE 5

Figure 12:
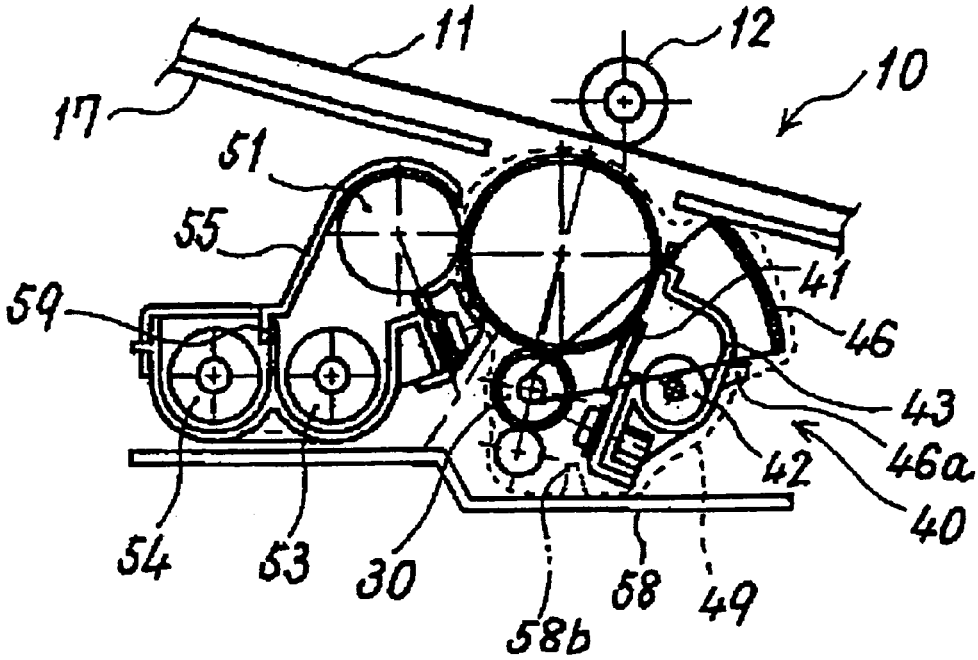
FIG. 12 shows Example 5 of the illustrative embodiment.

FIG. 12 shows Example 5 of the illustrative embodiment, particularly one of the image stations 1Y through 1Bk and belt 11 facing each other. As shown, the cleaning unit 49 additionally includes a shutter member 46 playing the role of a contact member. When the cleaning unit 49 is dismounted from the printer body, the shutter member 46 covers the surface of the drum 20 in order to protect it from the deposition of impurities and damage.

The shutter member 46 is supported by opposite ends of the shaft of the charge roller and is constantly biased by a spring such that it covers the upper portion of the drum 20 when the cleaning unit 49 is not mounted to the printer body. To mount the cleaning unit 49 to the printer body, the operator turns the shutter member 46 about the charge roller shaft to a position above the case 43 of the cleaning unit 49. The downward movement of the shutter 46 is limited when it abuts against a stop 46*a*. Therefore, even when the shutter member 46 contacts the case 17 and is pressed thereby, the shutter member 46 does not move further downward. Therefore, the gap between the cleaning roller 49 and the intermediate image transferring unit 10 can be maintained constant.

As for the rest of the configuration and mounting/dismounting procedure, Example 5 is identical with Examples 3 and 4.

EXAMPLE 6

Figure 13:
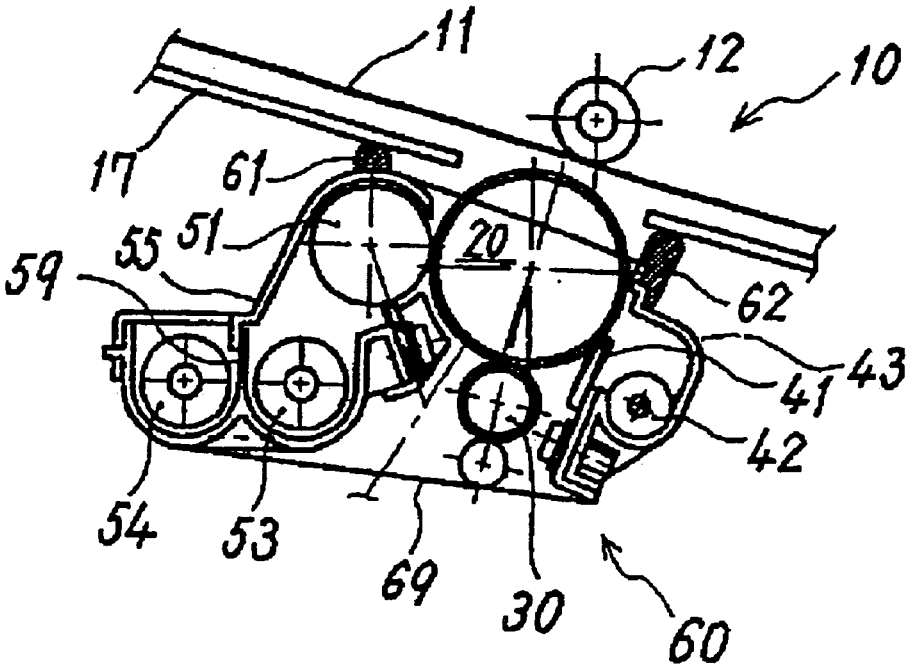
FIG. 13 shows Example 6 of the illustrative embodiment.

FIG. 13 shows Example 6 of the illustrative embodiment, particularly one of the image stations 1Y through 1Bk and belt 11 facing each other. As shown, the drum 20, developing device and drum cleaner are constructed into a single process cartridge 60 removably mounted to the printer body. A single support member 69 therefore supports the case 55 of the developing unit and the case of cleaning unit. Contact members 61 and 62 respectively protrude upward from part of the case 55 and part of the case 43 facing the case 17 of the intermediate image transferring unit 10. The tops of the contact members 61 and 62 contact the bottom of the case 17.

Figure 14:
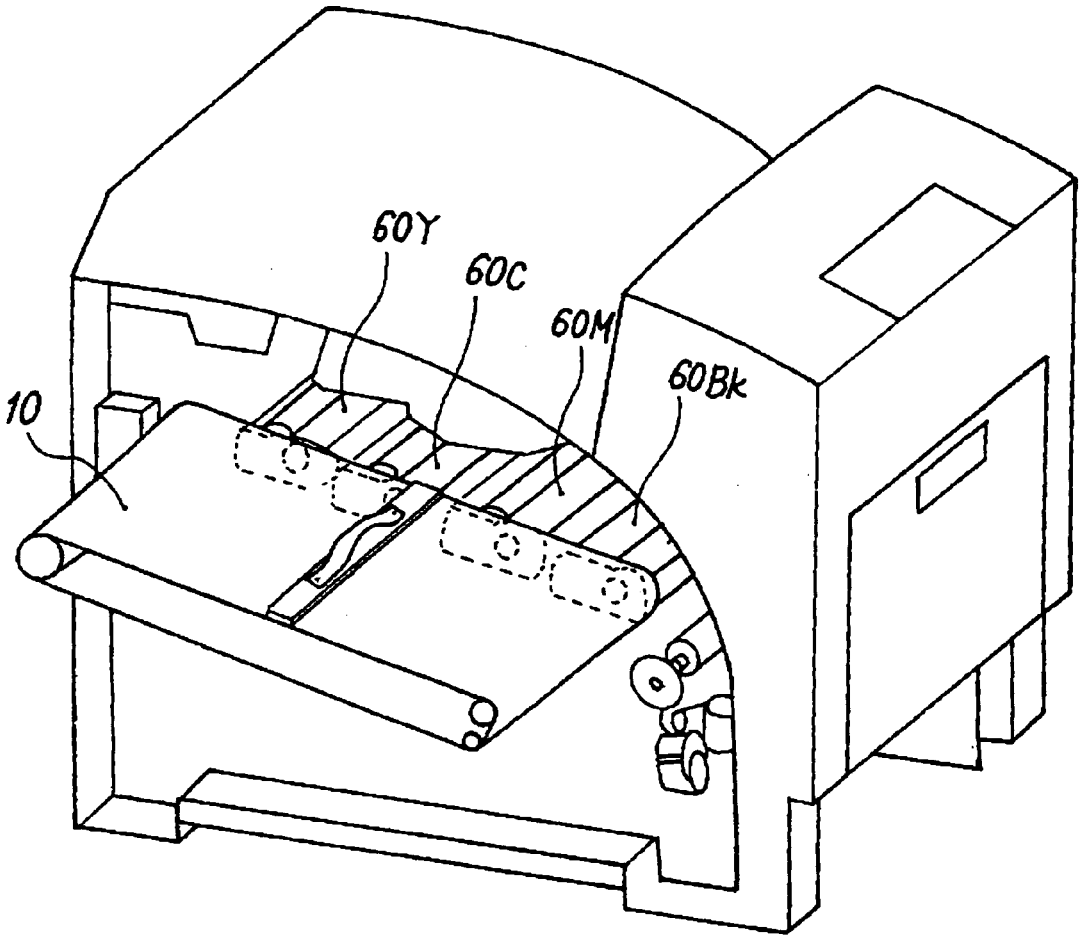
FIG. 14 shows an intermediate image transferring unit included in Example 6 in a position pulled out from the apparatus body.

To dismount the intermediate image transferring unit 10 from the printer body in order to, e.g., replace the belt 11, the operator opens the front door, holds the unit 10 with both hands and then pulls it out of the printer body as in Example 1. When the image transferring unit 10 is being so pulled out, the case 17 is held in contact with the contact members 61 and 62 and prevented from moving downward thereby. The image transferring unit 10 can be released from the printer body when fully pulled out as in Example 1. FIG. 14 shows the condition wherein the intermediate image transferring unit 10 is fully pulled out of the printer body. The operator can mount the intermediate image transferring unit 10 to the printer body.

To pull out the process cartridge 60, the operator opens the front door, holds the process cartridge 60 and then pulls it out of the printer body. At this instant, the contact members 61 and 62 of the process cartridge 60, contacting the bottom of the case 17, prevent the cartridge 60 from moving upward to thereby maintain the gap between the cartridge 60 and the intermediate image transferring unit 10 constant. The operator can mount the process cartridge 60 to the printer body by performing the above procedure in the reverse sequence.

EXAMPLE 7

Figure 15:
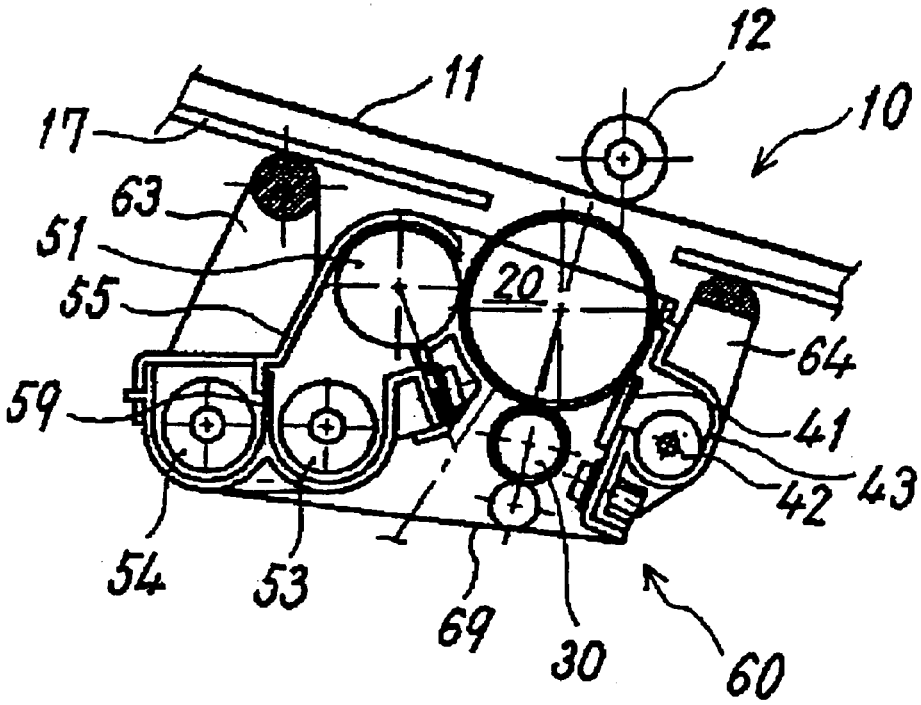
FIG. 15 shows Example 7 of the illustrative embodiment.

FIG. 15 shows Example 7 of the illustrative embodiment, particularly one of the image stations 1Y through 1Bk and belt 11 facing each other. As shown, grips 63 and 64, playing the role of contact members, protrude upward from the portions of the process cartridge 60 facing the case 17 of the intermediate image transferring unit 10. The tops of the grips 63 and 64 contact the bottom of the case 17. The grips 63 and 64 each are configured as described with reference to FIGS. 9B and 11B, respectively, and will not be described specifically in order to avoid redundancy.

When the process cartridge 60 is not mounted to the printer body, the grips 63 and 64 each can be gripped and lifted by hand. When the process cartridge 60 is mounted to the printer body, the tops of the grips 63 and 64 contact the bottom of the case 17 to thereby maintain the gap between the process cartridge 60 and the intermediate image transferring unit 10 constant.

As for the rest of the configuration and mounting/dismounting procedure, Example 7 is identical with Example 6. Of course, only one of the knobs 63 and 64 formed on the process cartridge 60 suffices.

EXAMPLE 8

Figure 16:
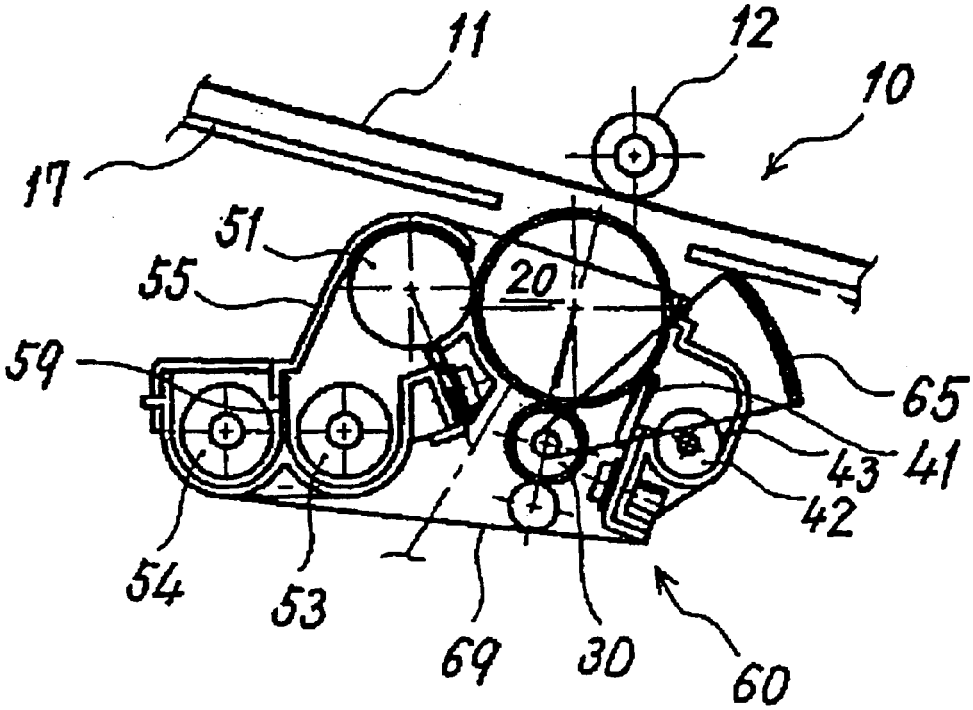
FIG. 16 shows Example 8 of the illustrative embodiment.

FIG. 16 shows Example 8 of the illustrative embodiment, particularly one of the image stations 1Y through 1Bk and belt 11 facing each other. As shown, the process cartridge 60 additionally includes a shutter member 65 playing the role of a contact member. When the process cartridge 60 is dismounted from the printer body, the shutter member 65 covers the surface of the drum 20 in order to protect it from the deposition of impurities and damage.

The shutter member 65 is supported by opposite ends of the charge roller shaft and is constantly biased by a spring such that it covers the upper portion of the drum 20 when the process cartridge 60 is not mounted to the printer body. To mount the process cartridge 60 to the printer body, the operator turns the shutter member 65 about the charge roller shaft to a position above the case 43 of the cleaning unit 49. The downward movement of the shutter 65 is limited when it abuts against a stop not shown. Therefore, even when the shutter member 65 contacts the case 17 and is pressed thereby, the shutter member 65 does not move further downward. Therefore, the gap between the process cartridge 60 and the intermediate image transferring unit 10 can be maintained constant.

As for the rest of the configuration and mounting/dismounting procedure, Example 8 is identical with Examples 6 and 7.

Figure 17:
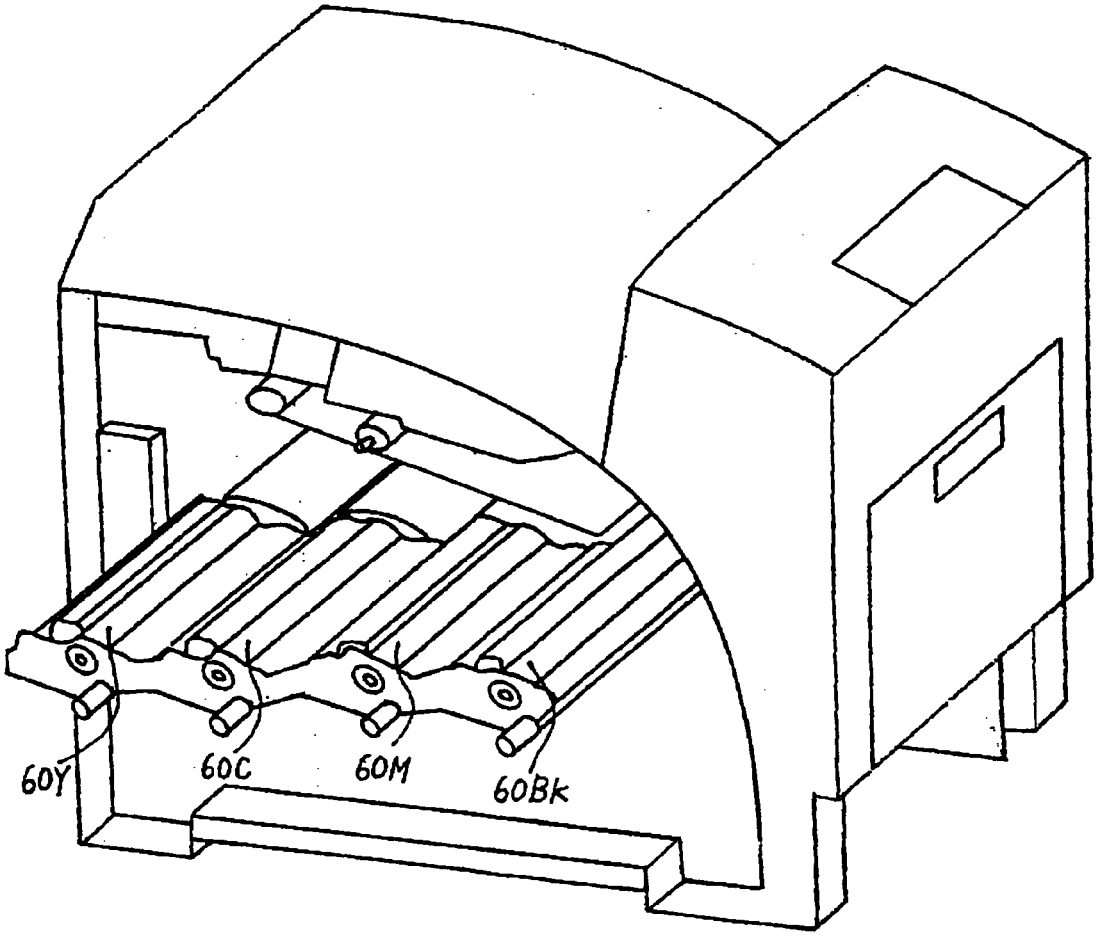
FIG. 17 shows a process cartridge, including four image stations, in a position pulled out of the apparatus body.

In Examples 6 through 8, four process cartridges 60, respectively assigned to the four image stations 1Y through 1Bk, are removably mounted to the printer body independently of each other. Alternatively, as shown in FIG. 17, the four process cartridges 60 may be constructed into a single process cartridge 60. FIG. 17 shows the single process cartridge 60 in a position pulled out of the printer body.

The contact members 44 through 46, 56, 57 and 61 through 65 and the portions of the cases contacting them should preferably be slidable as far as possible and smaller in contact area as small as possible from the mounting/dismounting or replacement standpoint. To enhance slidability means to enhance the coefficient of friction, increasing wear resistance and obviating noise and vibration ascribable to friction. To enhance slidability, the contact members and corresponding portions of the cases may be formed of highly slidable materials or provided with highly slidable seal members thereon. Highly slidable materials include materials containing fluorine, e.g., fluorocarbon resin, polyolefin resin, polyacetal resin, and silicone. The high slidable sheet members may be formed of materials containing fluorine, e.g., Teflon (trade name) and ultrahigh-molecular-weight polyethylene.

While the contact members 44 through 46, 56, 57 and 61 through 65 have been shown and described as being provided on the developing unit, cleaning unit 49 or process cartridge 60, they may be provided on the intermediate image transferring unit 10. Further, such contact members may be positioned between all of or part of the image stations 1Y through 1Bk and the intermediate image transferring unit 10, as desired.

In the illustrative embodiment, the case 17 of the intermediate image transferring unit 10 covers all of the image stations 1Y through 1Bk. Alternatively, the case 17 may be absent from the position where the unit 10 faces the image station 1Y to the position where it faces the image station 1Bk, so that the belt 11 is exposed between the above two positions. In this case, the contact members are provided on the developing units 50C and 50M, cleaning units 49C and 49M and process cartridges 60C and 60M, but are provided only on the developing units 50Y and 50Bk, cleaning units 49Y and 49Bk and process cartridges 60Y and 60Bk.

Usually, in a color printer, the black image station 1Bk is used more frequency than the other image stations 1Y through 1M. When the image station Bk is positioned at the end as in the illustrative embodiment, the contact members can be applied to the developing unit, cleaning unit and process cartridge located at the end that should be mounted and dismounted more frequency than the others.

The contact members provided on the removable members do not have to constantly contact the frame of the surrounding member when the removable members are present on the printer body or being mounted or dismounted.

Of course, the illustrative embodiment is similarly applicable to an image forming apparatus in which the drums 20 are replaced with photoconductive belts or similar belts. This is also true with a recording medium holding member. Also, the intermediate image transfer system, including the belt 11, may be replaced with a direct image transfer system that directly transfers a toner image from the drums 20 to a sheet, in which case, too, use may be made of a sheet conveying belt. Such belts each may be configured to be removable from the printer body.

Further, the optical writing unit 8 may use LEDs (Light Emitting Diodes) in place of the lasers shown and described. The digital printer shown and described may be replaced with an analog printer while the color printer may be replaced with a monochromatic printer. Of course, the image forming apparatus to which the illustrative embodiment may be implemented as, e.g., a copier or a facsimile apparatus.

Examples 1 through 8 shown and described achieve various unprecedented advantages, as enumerated below.

(1) In Example 1, when the intermediate image transferring unit 10 or the developing unit 50 is being mounted to or dismounted from the apparatus body, the contact members 56 continuously contact the bottom of the case 17 of the intermediate image transferring unit 10, maintaining the small gap between the unit 10 or 50 and the case 17 constant to thereby obviate play. It is therefore not necessary to provide the distance between the unit 10 and the drum 20 and the distance between the case 55 of the developing unit and the case 17 with margins taking account of play, reducing the size of the apparatus in the direction of height. In addition, each unit can be accurately positioned when mounted to the apparatus body because of the absence of play.

With the above configuration, it is possible to reduce the gap between the intermediate image transferring unit 10 and the drum 20 to such a degree that they do not contact each other, and to obviate sliding contact of the belt 11 and drum 20. This is also true with the gap between the case 55 and the intermediate image transferring unit 10. It follows that not only the size of the apparatus is reduced in the direction of height, but also the life of the belt 11 and that of the drum 20 can be extended.

Because the belt 11 and drum 20 do not rub each other, the user of the apparatus can easily mount or dismount the image transferring unit 10 or the developing unit 50 without being nervous about damage to the members concerned.

Further, the operator, intending to mount or dismount a desired unit, should only insert the unit until the unit abuts against an abutment positioned in the apparatus body or until an abutment provided on the unit abuts against a case disposed in the apparatus body. Example 1 therefore allows the unit to be inserted into the apparatus body more easily than when, e.g., the unit is inserted by guiding guided by grooves formed in the apparatus body.

(2) In Example 2, the developing unit 50 is provided with a grip serving as a contact member. This successfully simplifies the structure of the developing unit 50 while reducing cost, compared to the case in which a separate contact member is used. Example 2, of course, achieves the same advantages as Example 1.

(3) In Example 3, the contact member 44 continuously contacts the bottom of the case 17 of the intermediate image transferring unit 10 when the unit 10 or 49 is being mounted or dismounted, maintaining the small gap between the unit 10 or 50 and the case 17 constant to thereby obviate play. It is therefore not necessary to provide the distance between the unit 10 and the drum 20 and the distance between the case 43 of the cleaning unit and the case 17 with margins taking account of play, reducing the size of the apparatus in the direction of height.

With the above configuration, it is possible to reduce the gap between the intermediate image transferring unit 10 and the drum 20 to such a degree that they do not contact each other, and to obviate sliding contact of the belt 11 and drum 20. This is also true with the gap between the case 43 and the intermediate image transferring unit 10. It follows that not only the size of the apparatus is reduced in the direction of height, but also the life of the belt 11 and that of the drum 20 can be extended.

Because the belt 11 and drum 20 do not rub each other, the user of the apparatus can easily mount or dismount the image transferring unit 10 or the cleaning unit 49 without being nervous about damage to the members concerned.

Further, the user does not have to frequently call a service person or bear the extra expense for services.

(4) In Example 4, the cleaning unit 49 is provided with a grip serving as a contact member. This successfully simplifies the structure of the cleaning unit 49 while reducing cost, compared to the case in which a separate contact member is used. In addition, Example 4 achieves the same advantages as Example 3.

(5) In Example 5, the cleaning unit 49 is provided with a shutter member serving as a contact member. This also successfully simplifies the structure of the cleaning unit 49 while reducing cost, compared to the case in which a separate contact member is used. In addition, Example 5 achieves the same advantages as Example 3.

(6) In Example 6, the contact member of the process cartridge 60 continuously contacts the bottom of the case 17 of the intermediate image transferring unit 10 when the unit 10 or the process cartridge 60 is being mounted or dismounted, maintaining the small gap between the unit 10 or the process cartridge 60 and the case 17 constant to thereby obviate play. The process cartridge case includes the cases 55 and 43. It is therefore not necessary to provide the distance between the unit 10 and the drum 20 and the distance between the process cartridge case and the case 17 with margins taking account of play, reducing the size of the apparatus in the direction of height.

With the above configuration, it is possible to reduce the gap between the intermediate image transferring unit 10 and the drum 20 to such a degree that they do not contact each other, and to obviate sliding contact of the belt 11 and drum 20. This is also true with the gap between the process cartridge case and the intermediate image transferring unit 10. It follows that not only the size of the apparatus is reduced in the direction of height, but also the life of the belt 11 and that of the drum 20 can be extended.

Because the belt 11 and drum 20 do not rub each other, the user of the apparatus can easily mount or dismount the image transferring unit 10 or the process cartridge 60 without being nervous about damage to the members concerned.

(7) In Example 7, the process cartridge 60 is provided with grips 63 and 64 serving as contact members. This successfully simplifies the structure of the process cartridge 60 while reducing cost, compared to the case in which a separate contact member is used. In addition, Example 7 achieves the same advantages as Example 6.

(8) In Example 8, the process cartridge 60 is provided with a shutter member serving as a contact member. This also successfully simplifies the structure of the process cartridge 60 while reducing cost, compared to the case in which a separate contact member is used. In addition, Example 8 achieves the same advantages as Example 6.

Second Embodiment

Figure 18:
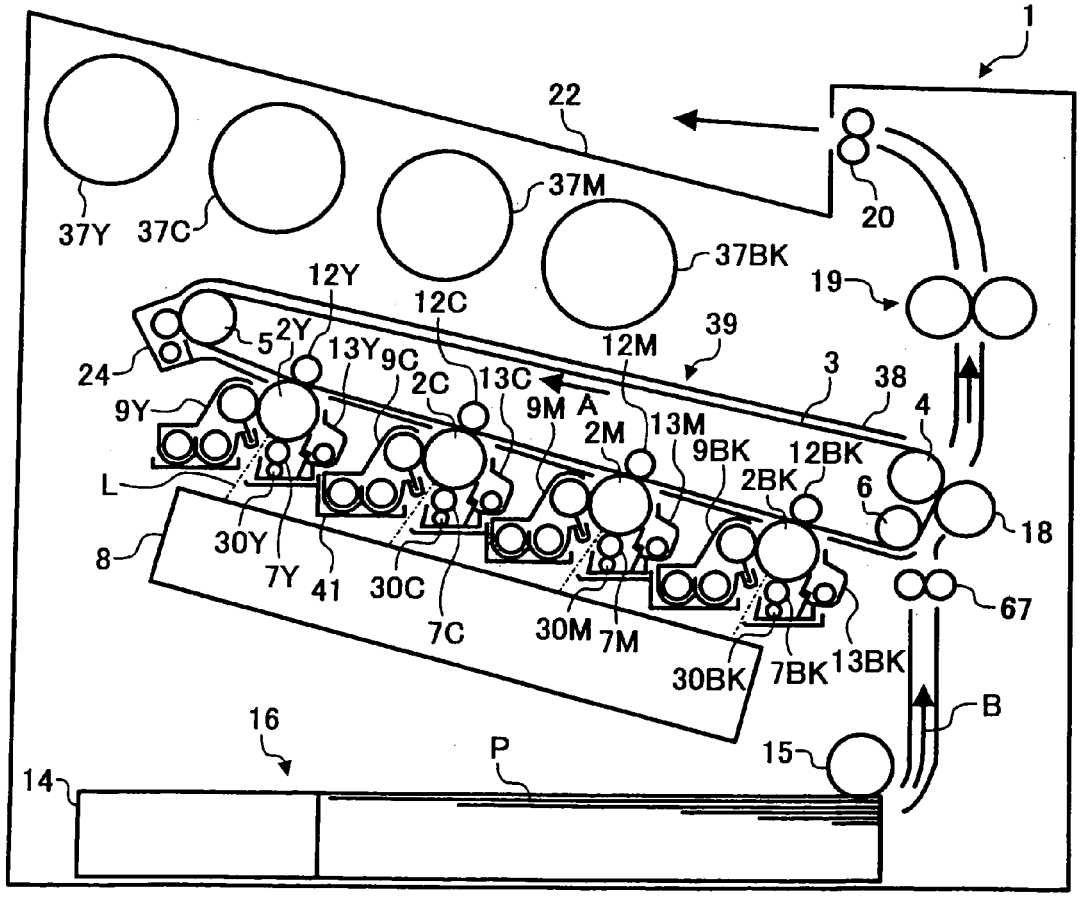
FIG. 18 shows a second embodiment of the image forming apparatus in accordance with the present invention.

A second embodiment of the present invention, also implemented as a color printer, will be described with reference to FIG. 18. As shown, the color printer includes a printer body 1 in which four photoconductive drums or image carriers 2Y through 2BK and an intermediate image transfer belt 3 are disposed. The belt 3 is passed over rollers 4, 5 and 6 and caused to move in a direction indicated by an arrow A in contact with the drums 2Y through 2BK. Toner images formed on the drums 2Y through 2BK are sequentially transferred to the belt 3 one above the other in the same manner as in the first embodiment. Let the following description concentrate on the drum 2Y by way of example for the same reason as in the first embodiment.

Figure 19:
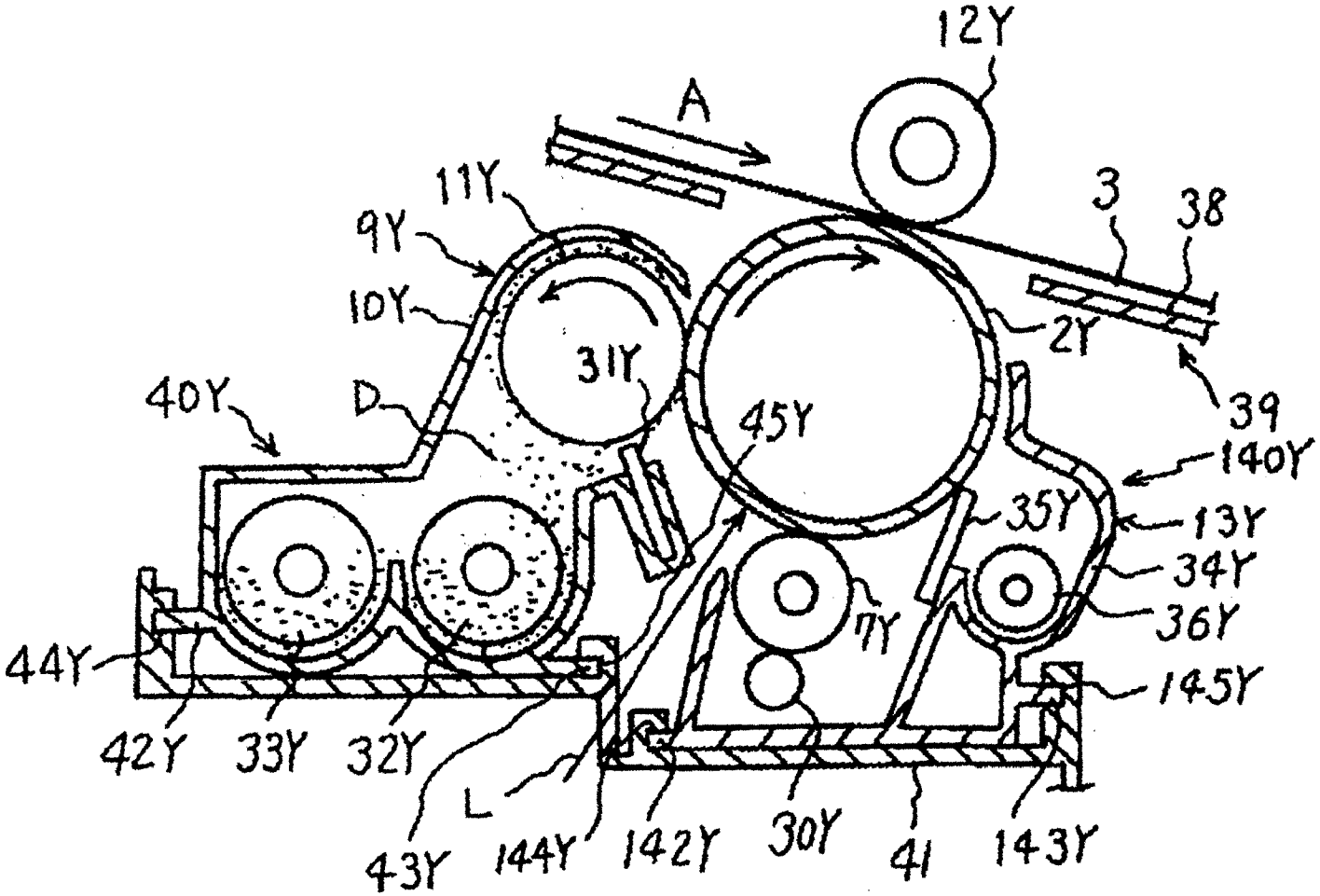
FIG. 19 is an enlarged view showing a first drum included in the second embodiment together with image forming devices arranged therearound.

FIG. 19 shows the drum 2Y and process units arranged around the drum 2Y in an enlarge scale. As shown, while the drum 2Y is rotated clockwise, as viewed in FIG. 19, a charge roller or charger 7Y uniformly charges the surface of the drum 2Y to preselected polarity. A cleaning roller 30Y is held in contact with the charge roller 7Y for cleaning the surface thereof. An optical writing unit 8 shown in FIG. 18 scans the charged surface of the drum 2Y with a laser beam L in accordance with image data to thereby form a latent image. A developing device 9Y develops the latent image with yellow toner for thereby producing a corresponding toner image.

The developing device 9Y includes a case 10Y storing a dry developer D. A developing roller 11Y is rotatably supported by the case 10Y and faces the drum 2Y via an opening formed in the case 10Y. A doctor blade or metering member 31Y is configured to regulate the amount of the developer deposited on the developing roller 11Y. A first and a second screw 32Y and 33Y face the developing roller 11Y and convey the developer D toward the developing roller 11Y, which is rotated in a direction indicated by an arrow, while agitating the developer D. The developer D is then deposited on the developing roller 11Y. The developing roller 11Y in rotation conveys the developer to a developing zone between the roller 11Y and the drum 2Y while the doctor blade 31Y causes the developer to form a thin layer on the roller 11Y. In the developing zone, the toner of the developer is electrostatically transferred from the developing roller 11Y to the drum 2Y, developing the latent image. While the developer may be either one of a one-ingredient or a two-ingredient developer, the illustrative embodiment is also assumed to use a two-ingredient developer made up of toner grains and carrier grains.

A primary image transfer roller 12Y faces the drum 2Y with the intermediary of the belt 3. A bias for image transfer is applied to the primary image transfer roller 12Y, so that the toner image is transferred from the drum 2Y to the belt 3 moving in the direction A. A drum cleaner 13Y removes the toner left on the drum 2Y after the primary image transfer.

In the illustrative embodiment, the drum cleaner or cleaning device 13Y includes a case 34Y formed with an opening facing the drum 2Y. A cleaning blade 35Y is affixed to the case 34Y at one end and held in contact with the drum 2Y at the other end so as to remove toner left on the drum 2Y. A screw 36Y conveys the toner removed by the cleaning blade 35Y to a waste toner bottle not shown. The charge roller 7Y is applied with a bias implemented as an AC-biased DC voltage, so that part of the drum 2Y moved away from the drum cleaner 13Y is discharged and charged by the charge roller 7Y at the same time and prepared for the next image forming cycle thereby.

Figure 23:
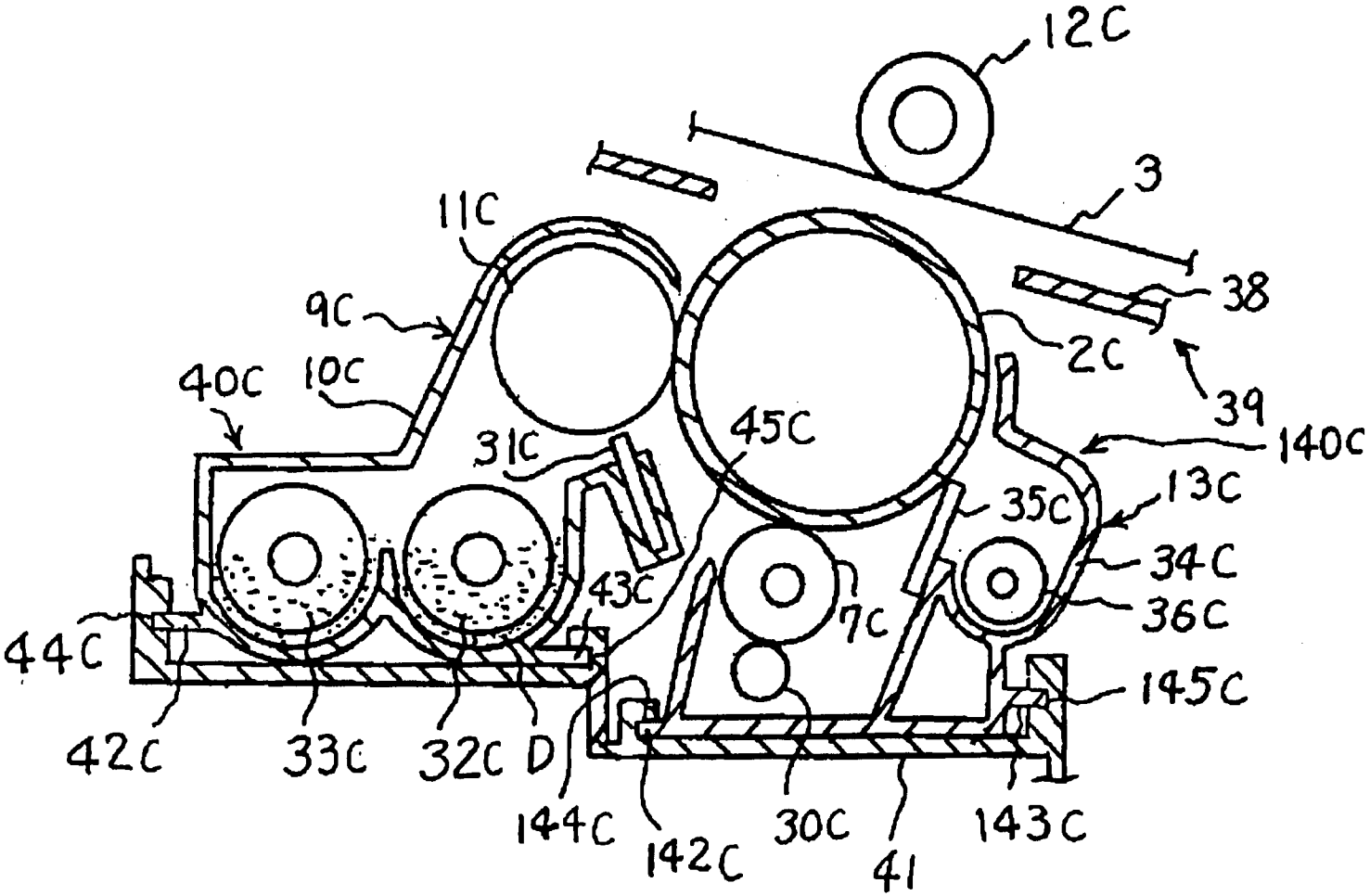
FIGS. 23 through 25 each show projections and guide channels formed at particular positions.
Figure 24:
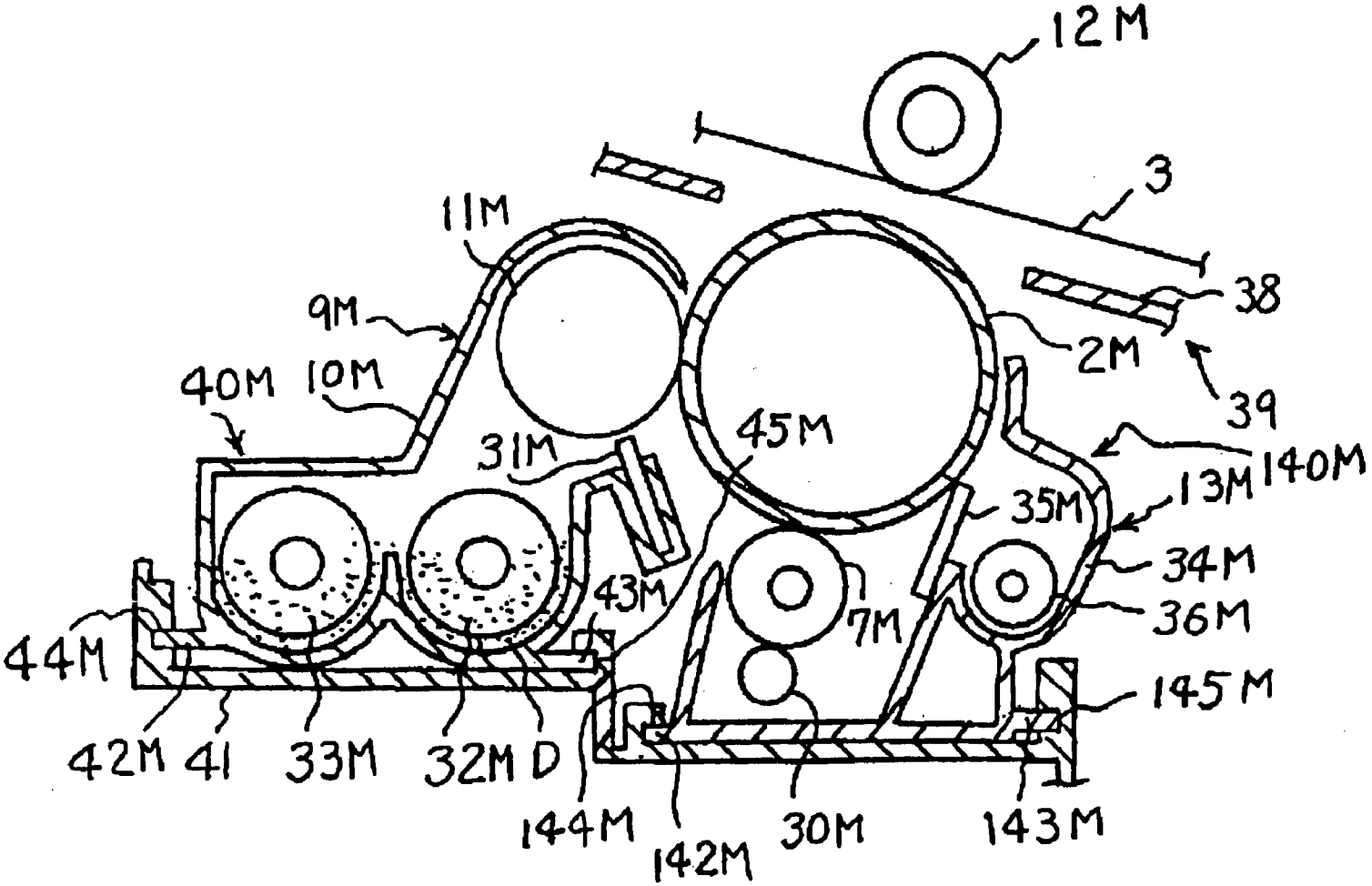
Figure 25:
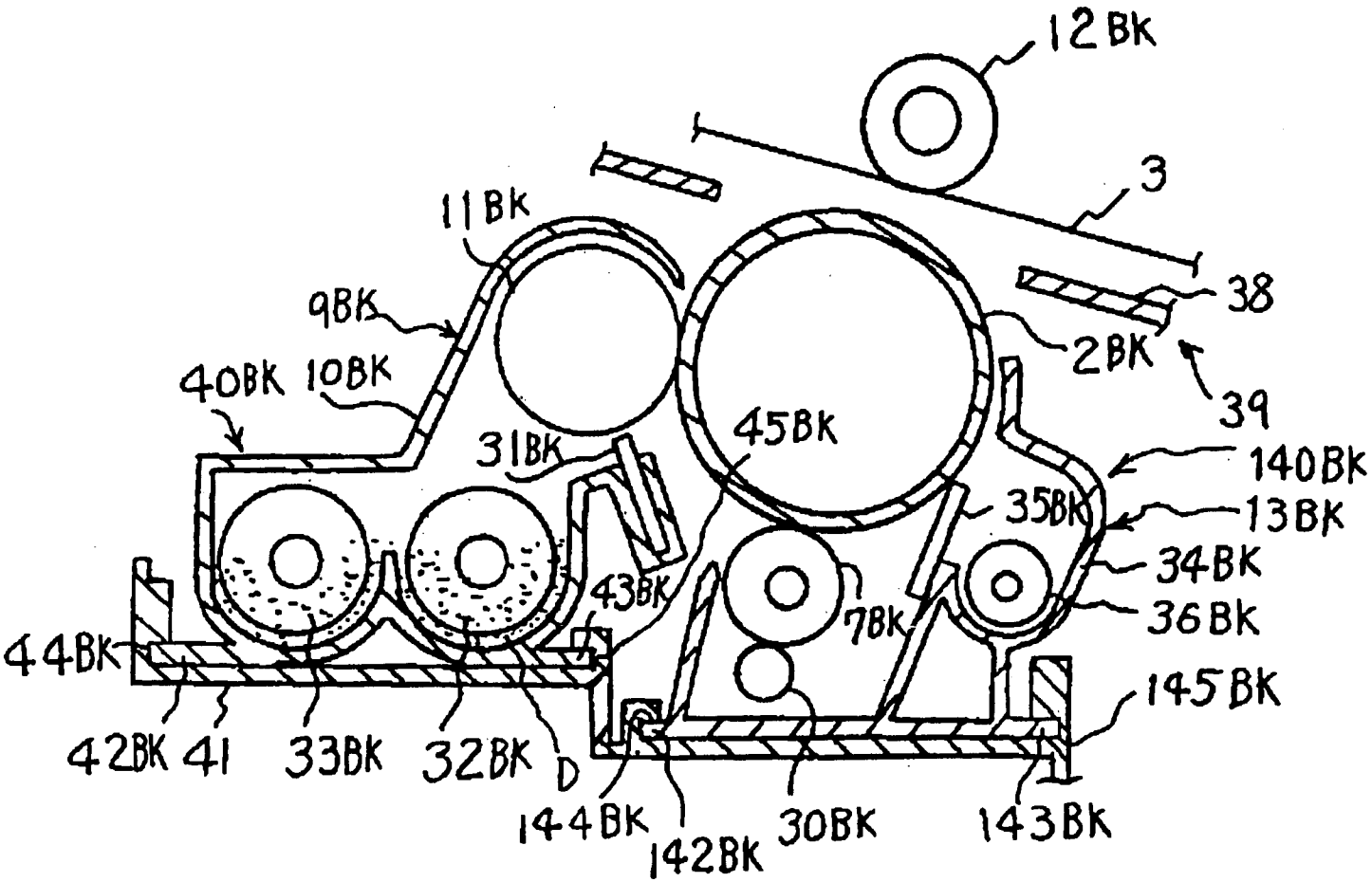

A cyan, a magenta and a black toner image are respectively formed on the drums 2C, 2M and 2BK in exactly the same manner as the yellow toner image and sequentially transferred to the belt 3 over the yellow toner image present on the belt 3, completing a full-color image. Drum cleaners are also associated with the drums 2C, 2M and 2BK for removing residual toner after image transfer. In FIG. 18, as well as in FIGS. 23 through 25 to follow, process units arranged around the drums 2Y through 2BK are distinguished from each other by suffices Y through BK.

Referring again to FIG. 18, a sheet feeder 16 is positioned in the lower portion of the printer body 1 and includes a sheet cassette 14 loaded with a stack of sheets P and a pickup roller 15. The pickup roller 15 pays out the top sheet P in a direction indicated by an arrow B when caused to rotate. The sheet P is once stopped by a registration roller pair 67 and then conveyed thereby toward a nip between part of the belt 3 passed over the roller 4 and a secondary image transfer roller 18 facing it at preselected timing. The secondary image transfer roller 18, applied with a preselected bias, transfers the full-color image from the belt 3 to the sheet P.

The sheet P, carrying the full-color toner image thereon, is conveyed upward to a fixing unit 19 and has the toner image fixed thereon by the fixing unit 19. The sheet or print P is then driven out of the printer body 1 to a stacking portion 22 positioned on the top of the printer body 1 by an outlet roller pair 20. A belt cleaner 24 removes toner left on the belt 24 after the secondary image transfer.

Toner bottles 37Y, 37C, 37M and 37BK are disposed in the printer body 1 and respectively store yellow toner, cyan toner, magenta toner and black toner. The toner is replenished from any one of the toner bottles 37Y through 37BK to corresponding one of the developing units 9Y through 9BK via a path, not shown, as needed.

The belt 3 is accommodated in a case 38 while the primary image transfer rollers 12Y through 12BK and rollers 4 through 6 are rotatably mounted on the case 38. The belt cleaner 24 is also mounted on the case 38. The belt 3, case 38, primary image transfer rollers 12Y through 12BK, rollers 4 through 6 and belt cleaner 24 are constructed into a single image transferring unit 39. The image transferring unit 39 transfers the toner images formed on the drums or image carriers 2Y through 2BK to the sheet or recording medium P via the belt 3, as stated earlier. In the illustrative embodiment, the image transferring unit 39 can be pulled out of the printer body 1 toward the front in a direction perpendicular to the sheet surface of FIG. 19 and inserted into the printer body 1 toward the rear in the above direction.

Figure 20:
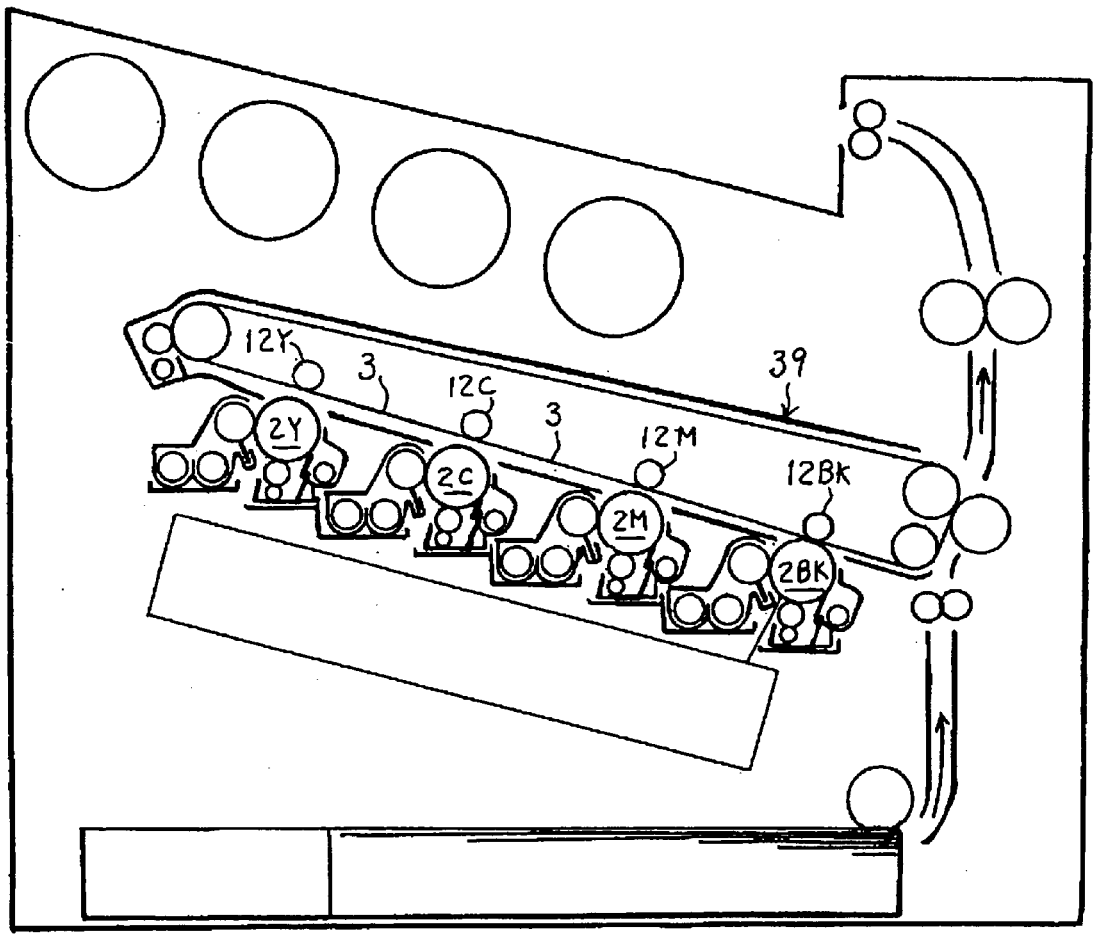
FIG. 20 shows an intermediate image transfer belt included in the second embodiment in a position released from the drums other than a drum assigned to black.

In the full-color mode, the drums 2Y through 2BK all are held in contact with the belt 3. On the other hand, in the black-and-white or monochromatic mode or in the stand-by condition of the printer, part of the belt 3 facing the drums 2Y through 2M and primary image transfer rollers 12Y through 12M are moved away from the drums 2Y through 2M, as shown in FIG. 20.

Figure 21:
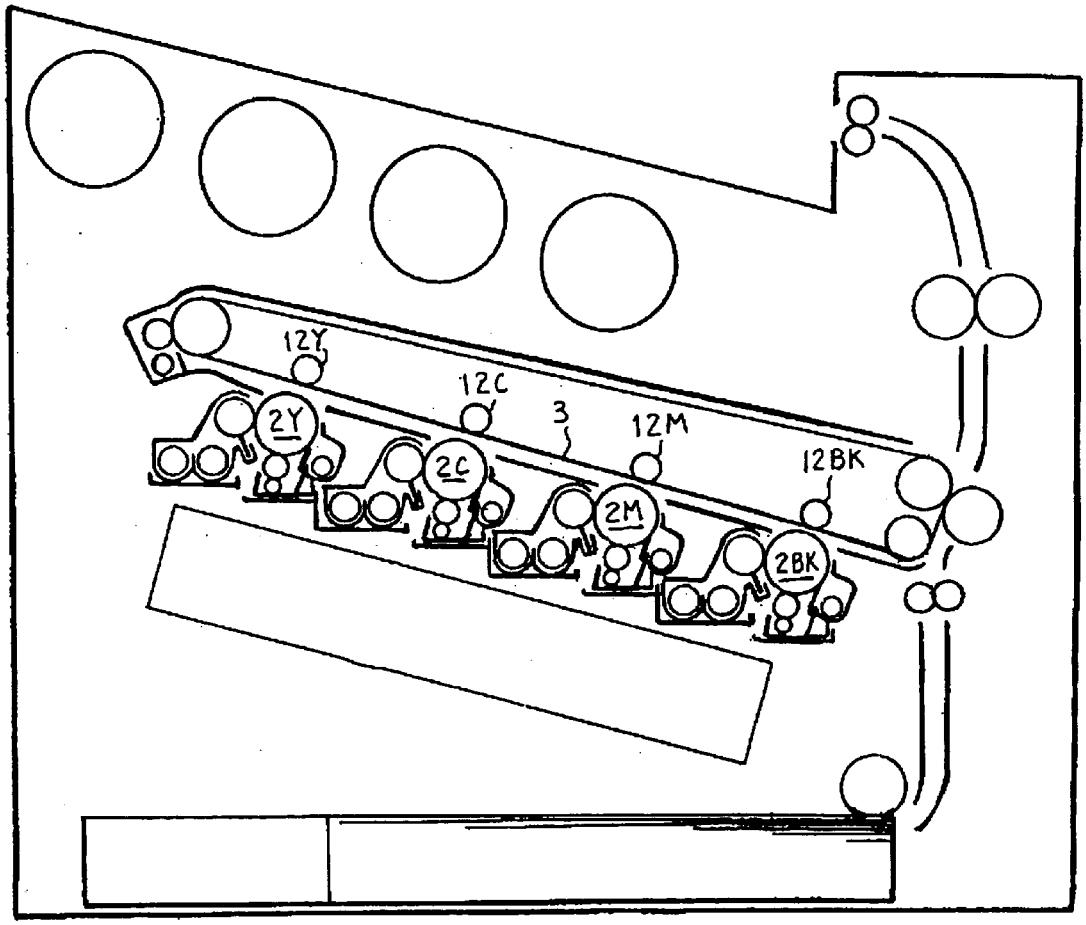
FIG. 21 is a view similar to FIG. 20, showing the belt released from all of the drums.

As shown in FIG. 21, when the image transferring unit 39 or an image forming unit, which will be described later, should be mounted to or dismounted from the printer body 1, part of the belt 3 facing the drum 2BK and primary image transfer roller 12BK are also moved away from the drum 2BK. That is, the belt 3 is released from all of the drums 2Y through 2BK.

In FIG. 19, the charge roller 7Y, developing unit 9Y and drum cleaner 13Y play the role of image forming devices for forming a toner image on the drum 2Y. This is also true with charge rollers 7C, 7M and 7BK, developing units 9C, 9M and 9BK and drum cleaners 13C, 13M and 13BK arranged around the other drums 2C, 2M and 2BK, respectively.

The drum or image carrier 2Y, for example, and one or more of the image forming devices assigned thereto are constructed into an image forming unit removable from the printer body 1 in the axial direction of the drum 2Y. Alternatively, the charge roller or charger 7Y and a support supporting it may be constructed into an image forming unit. Further, the developing device and drum cleaner or cleaning device each may be constructed into an image forming unit alone. Moreover, the developing device and image carrier may be combined in the form of an image forming unit. In addition, the image carrier and cleaning device may be constructed into an image forming unit, which may additionally include the charger. In the specific configuration shown in FIG. 19, the developing device 9Y constitutes an image forming unit 40Y alone while the cleaning device 13Y and image carrier 2Y constitute another image forming unit 140Y. In the image forming unit 140Y, the charger 7Y and cleaning roller 30Y are rotatably supported by the case 34Y of the cleaning device 13Y. The other image carriers 2C, 2M and 2BK and process units arranged therearound are also assume to be constructed into image forming units, see FIGS. 23 through 25. As shown in FIG. 18, the image forming units all are mounted on a single plate 41 affixed to the printer body 1.

The image forming units thus configured each are capable of being pulled out of or inserted into the printer body 1 in the same direction as the image transferring unit 39, i.e., in the axial direction of the image carrier. More specifically, assume that the operator desires to pull out the image forming unit 40Y or 140Y by way of example. Then, as shown in FIG. 21, the operator releases the belt 3 from all of the drums 2Y through 2BK and then pulls out the image forming unit 40Y or 140Y toward the front of the printer body 1. At this instant, if any one of the members constituting the image forming unit 40Y or 140Y contacts the image transferring unit 39, particularly the belt 3, then the former scratches the latter, resulting in wasteful replacement. This is also true when the image forming unit 40Y or 140Y is inserted into the printer body 1.

Figure 22:
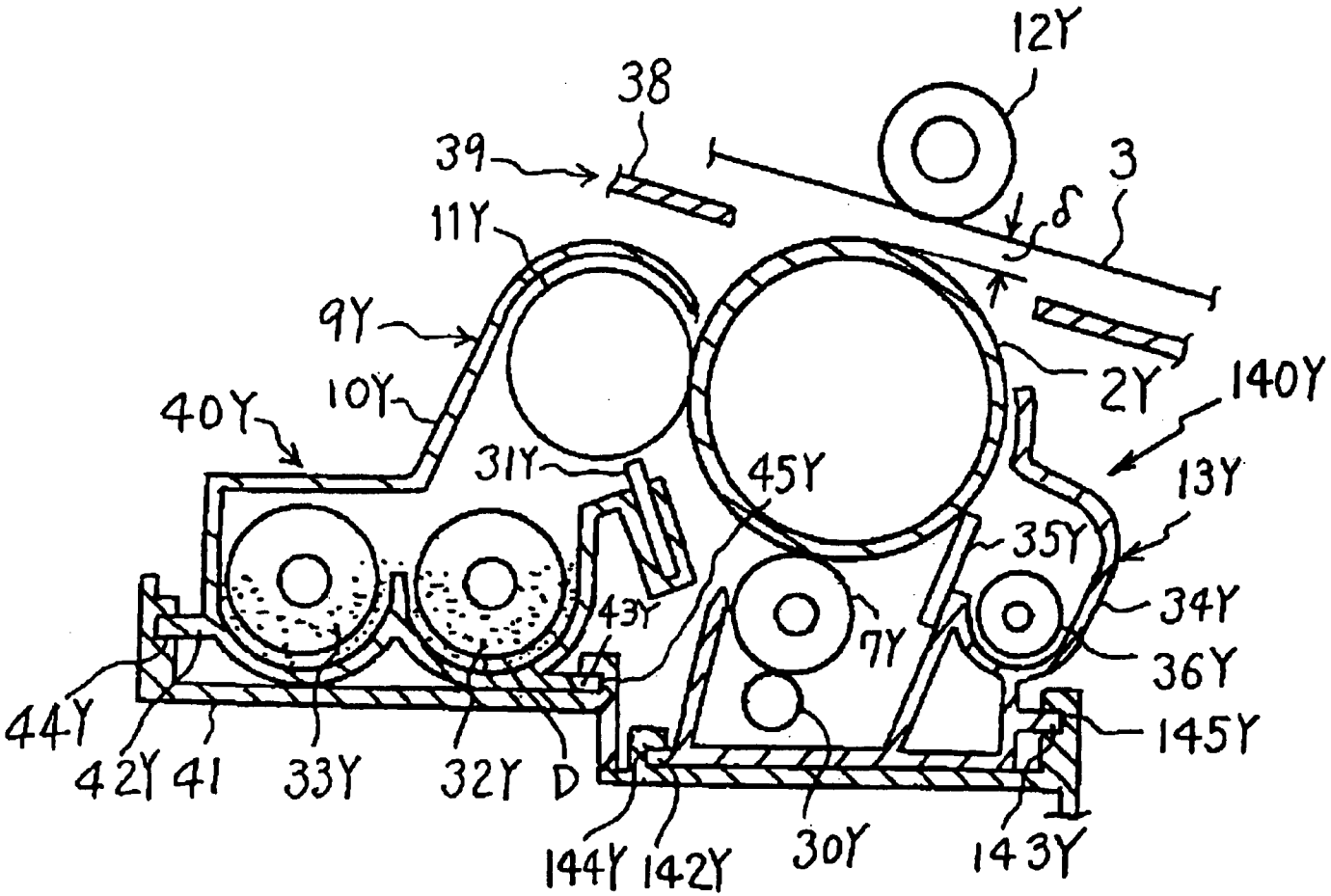
FIG. 22 shows the first drum and belt released from the drum.

In light of the above, the illustrative embodiment includes guide means for guiding the image forming unit to be mounted or dismounted to thereby prevent it from contacting the image transferring unit 39. More specifically, as shown in FIG. 22, a pair of projections 42Y and 43Y protrude substantially horizontally from the case 10Y of the image forming unit 40Y and are respectively received in guide channels 44Y and 45Y formed in the plate or support base 41. In this configuration, the projections 42Y and 43Y are respectively slidable in the guide channels 44Y and 45Y in the axial direction of the drum 2Y. Likewise, the case 34Y of the other image forming unit 140Y is formed with a pair of substantially horizontal projections 142Y and 143Y. The projections 142Y and 143Y are respectively received in guide channels 144Y and 145Y also formed in the plate 41 and are slidable in the axial direction of the drum 2Y.

As shown in FIG. 22, assume that the operator releases the belt 3 from the drum 2Y and then pulls the image forming unit 40Y forward in the axial direction of the drum 2Y, i.e., toward the front of the printer body 1 in the direction perpendicular to the sheet surface of FIG. 22. Then, the image forming unit 40Y moves forward while being supported by the support base 41, but does not contact the image transferring unit 9 because the projections 42Y and 43Y are received in the guide channels 44Y and 45Y, respectively. Stated another way, the guide means prevent the image forming unit 40Y from moving toward the image transferring unit 39, i.e., maintains the distance between them substantially constant. This is also true when the image forming unit 40Y is inserted into the printer body 1 with the projections 42Y and 43Y being engaged with the guide channels 44Y and 45Y, respectively.

When the other image forming unit 140Y is mounted to or dismounted from the printer body 1 in the axial direction of the drum 2Y, the projections 142Y and 143Y slide in the guide channels 144Y and 145Y, respectively, also preventing the image forming unit 140Y from contacting the image transferring device 39.

The guide means described above allows even the user of the printer to handle the image forming units 40Y and 140Y without damaging the image transferring unit 39. Should the drum 2Y and belt 3, among others, contact each other during mounting or dismounting of the image forming unit 140Y, the service life of the drum 2Y and that of the belt 3 would be reduced.

Because the guide means surely prevents the image forming unit from contacting the image transferring device, as stated above, it is not necessary to move the belt 3 away from the drum 2Y by a great distance before pulling out the image forming unit. This allows a distance δ, see FIG. 22, between the belt 3 and the drum 2Y to be reduced and therefore prevents the printer body 1 from increasing in size.

In the illustrative embodiment, the image transferring unit 39 can also be mounted to or dismounted from the printer body 1 in the same direction as the image forming units 40Y and 140Y, as stated previously. The guide means stated above surely prevents the image forming unit 40Y or 140Y from contacting the image transferring unit 39, as also stated previously. Therefore, when the image transferring unit 39 and image forming units 40Y and 140Y should be mounted to the printer body 1 at the same time, it is preferable to mount the image transferring unit 39 and then mount the image forming units 40Y and 140Y. Also, it is preferable to dismount the image forming units 40Y and 140Y and then dismount the image transferring unit 39. Such a procedure surely prevents the image forming units 40Y and 140Y from interfering with the image transferring unit 39.

While guide means identical with the guide means shown in FIG. 22 may also be assigned to the other drums 2C, 2M and 2BK and image forming devices associated therewith, the guide means may be provided with different configurations from each other. Specifically, FIGS. 22 through 25 respectively show image forming units 40C and 140C including the drum 2C and image forming devices associated therewith, image forming units 40M and 140M including the drum 2M and image forming devices associated therewith, and image forming units 40BK and 140BK including the drum 2BK and image forming devices associated therewith. As shown, projections 42Y, 42C, 42M and 42BK and guide channels 44Y, 44C, 44M and 44BK, respectively guiding the image forming units 40Y, 40C, 40M and 40BK, are different in position from each other. Likewise, projections 143Y, 143C, 143M and 143BK and guide channels 145Y, 145C, 145M and 145BK, respectively guiding the image forming units 140Y, 140C, 140M and 140BK are different in position from each other.

The configurations shown in FIGS. 22 through 25 are also successful to achieve the advantages described with reference to FIG. 22. Further, because the projections and guide channels assigned to the image forming units 40Y through 40BK and 140Y through 140BK are different in position from each other, the operator is prevented from inadvertently mounting the image forming units to unexpected positions. This obviates the replenishment of toner to unexpected one of the developing units and therefore the mixture of colors, which would degrade image quality. The projections 43Y through 43BK and 142Y through 142BK may also be shifted in position from each other.

Figure 26:
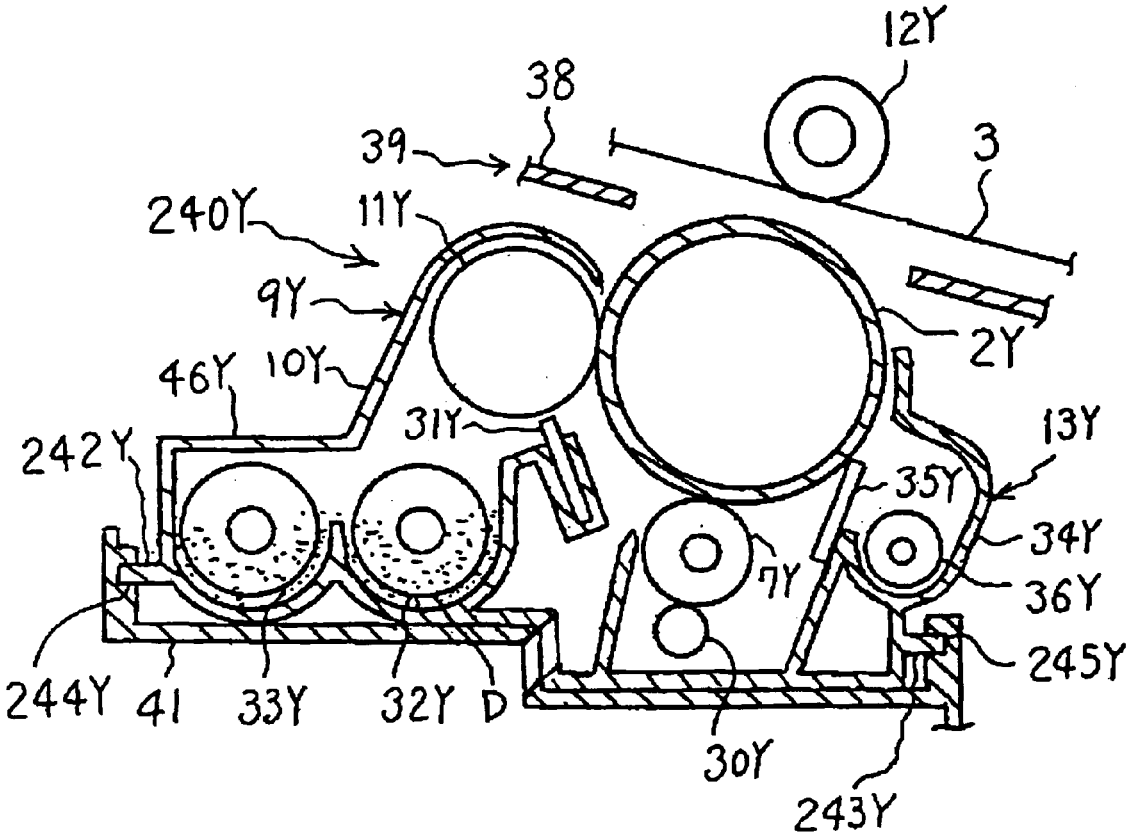
FIG. 26 shows a specific process cartridge constituting an image forming unit.

In the illustrative embodiment, the image forming units 40Y through 40BK respectively include the developing units 9Y through 9BK respectively assigned to the drums 2Y through 2BK while the image forming units 140Y through 140BK respectively include the drum cleaners or cleaning devices 13Y through 13BK. Assume that the image forming unit, including the drum or image carrier and at least one image forming device for forming a toner image on the drum constitute a so-called process cartridge. Then, in an image forming apparatus shown in FIG. 26, the case 10Y of the developing unit 9Y and the case 34Y of the drum cleaner 13Y are constructed into a single unit case 46Y. Also, the developing unit 9Y, drum cleaner 13Y, charge roller 7Y and cleaning roller 30Y are constructed into a single process cartridge 240Y. In this configuration, too, the unit case 46Y is formed with a pair of projections 242Y and 243Y while the support base 41 is formed with a guide channels 244Y and 245Y receiving the projections 242Y and 243Y, respectively. Such guide means can also prevent the process cartridge 240Y from contacting the image transferring unit 39 when the process cartridge 240Y is mounted or dismounted in the axial direction of the drum 2Y.

Again, it is preferable to mount the image transferring unit 39 and then mount the process cartridge 240Y or dismount the process cartridge 240Y and then dismount the image transferring unit 39.

While the illustrative embodiment is implemented as an image forming apparatus of the type including a plurality of image carriers, the present invention is similarly applicable to an image forming apparatus of the type including a single image carrier. Further, the present invention is practicable even with an image transferring device including a sheet conveying belt in place of the intermediate image transfer belt and sequentially transferring toner images from image carriers to a sheet or recording medium. Moreover, the present invention is practicable with an image transferring device not including a belt, but directly transferring a toner image from an image carrier to a sheet with an image transfer roller.

Third Embodiment

A third embodiment of the present invention, also implemented as a color printer, will be described with reference to FIG. 27. Because the third embodiment is similar in construction and operation to the second embodiment described with reference to FIG. 18, the following description will concentrate on features characterizing the third embodiment.

Figure 27:
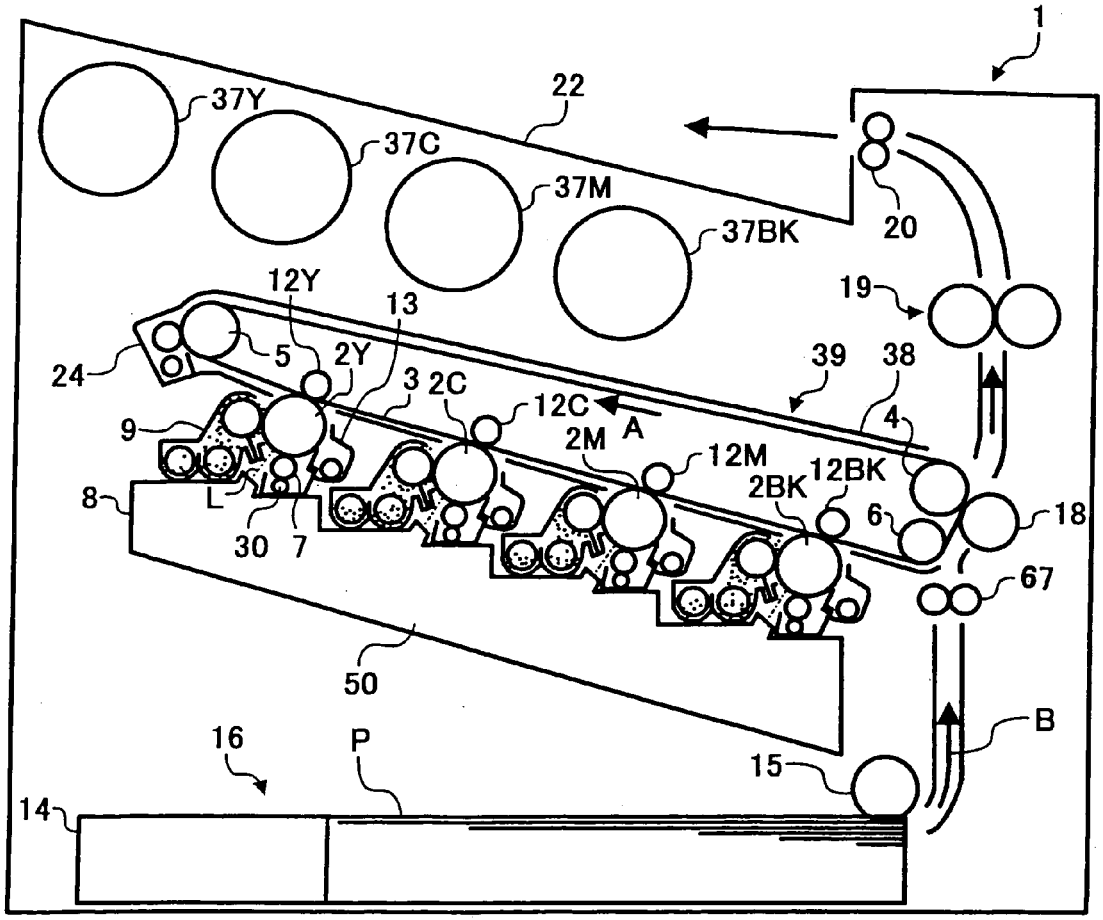
FIG. 27 shows a third embodiment of the image forming apparatus in accordance with the present invention.

As shown in FIG. 27, the color printer includes an optical writing unit 8 including a case 50 in which lasers, not shown, a polygonal mirror, an fθ lens and other conventional optical devices, not shown, are arranged. The case 50 is formed with apertures 51 for emitting laser beans L. The lasers may, of course, be replaced with an LED array.

Figure 28:
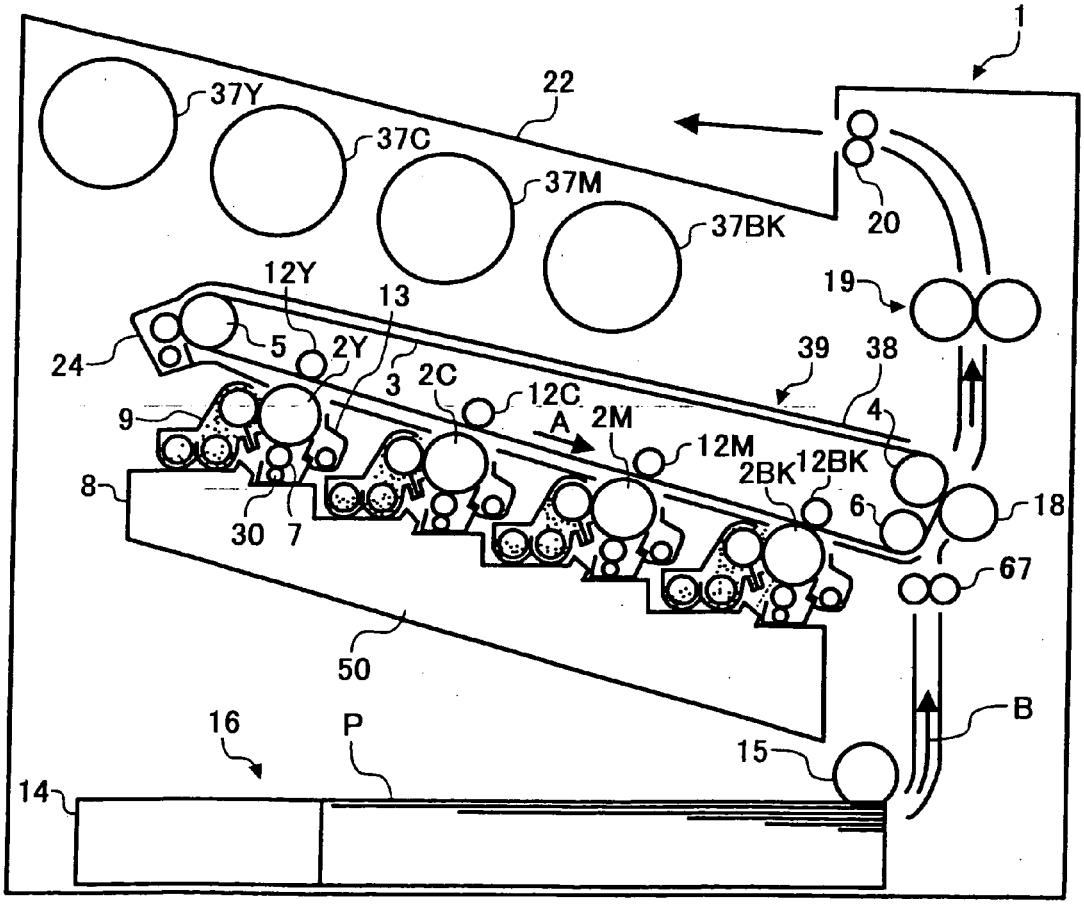
FIG. 28 shows the intermediate image transfer belt in a position released from the drums other than one assigned to black in the third embodiment.

In the full-color mode, the drums 2Y through 2BK all are held in contact with the belt 3. On the other hand, in the black-and-white or monochromatic mode or in the stand-by condition of the printer, part of the belt 3 facing the drums 2Y through 2M and primary image transfer rollers 12Y through 12M are moved away from the drums 2Y through 2M, as shown in FIG. 28.

Figure 29:
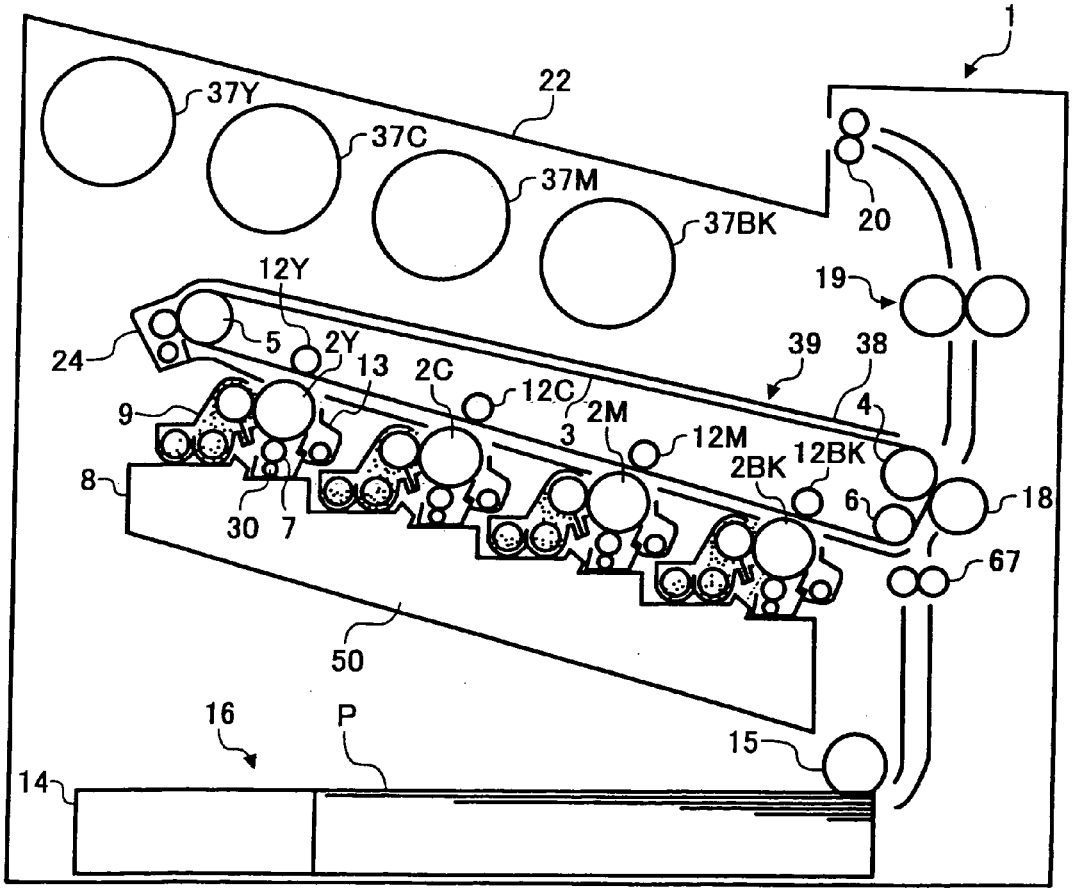
FIG. 29 is a view similar to FIG. 28, showing the belt in a position released from all of the drums.

As shown in FIG. 29, when an image forming unit to be described later should be mounted to or dismounted from the printer body 1, part of the belt 3 facing the drum 2BK and primary image transfer roller 12BK are also moved away from the drum 2BK. That is, the belt 3 is released from all of the drums 2Y through 2BK.

Figure 30:
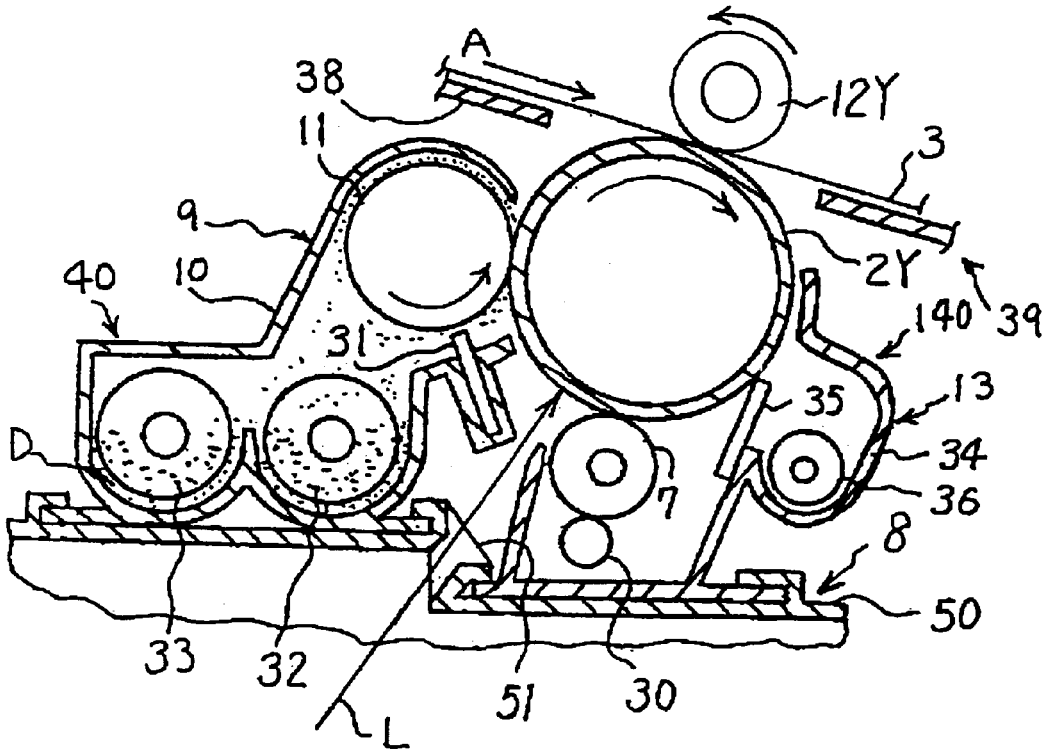
FIG. 30 shows the first drum and image forming devices arranged therearound.

FIG. 30 shows a charge roller or charger 7 in addition to the optical writing unit 8, developing unit 9 and cleaning unit 13 that constitute image forming devices for forming a toner image on the drum 2Y. This is also true with charge rollers, developing units and cleaning units arranged around the other drums 2C, 2M and 2BK.

One or more of the drum or image carrier and image forming devices other than the optical writing unit 8 are constructed into a single image forming unit removable from the printer body 1 in the axial direction of the drum. Alternatively, the charger and a support supporting it may be constructed into an image forming unit. Further, the developing device and drum cleaner or cleaning device each may be constructed into an image forming unit alone. Moreover, the developing device and image carrier may be combined in the form of an image forming unit. In addition, the image carrier and cleaning device may be constructed into an image forming unit, which may additionally include the charger.

In the specific configuration shown in FIG. 30, the developing device 9 constitutes an image forming unit 40 alone while the cleaning device 13 and image carrier 2 constitute another image forming unit 140. In the image forming unit 140, the charger 7 and cleaning roller 30 are rotatably supported by the case 34 of the cleaning device 13. The other image carriers 2C, 2M and 2BK and process units arranged therearound are also assume to be constructed into image forming units.

The image forming units 40 and 140 each are capable of being mounted to or dismounted from the printer body 1 in the axial direction of the image drum, i.e., in the same direction as the image transferring device 39 in the event of, e.g., inspection, repair or replacement. At this instant, if any one of the members constituting the image forming unit 40 or 140 contacts the image transferring unit 39, particularly the belt 3, then the former scratches the latter, resulting in wasteful replacement. This is also true when the image forming units 40 and 140 hit against each other when being mounted or dismounted.

Figure 31:
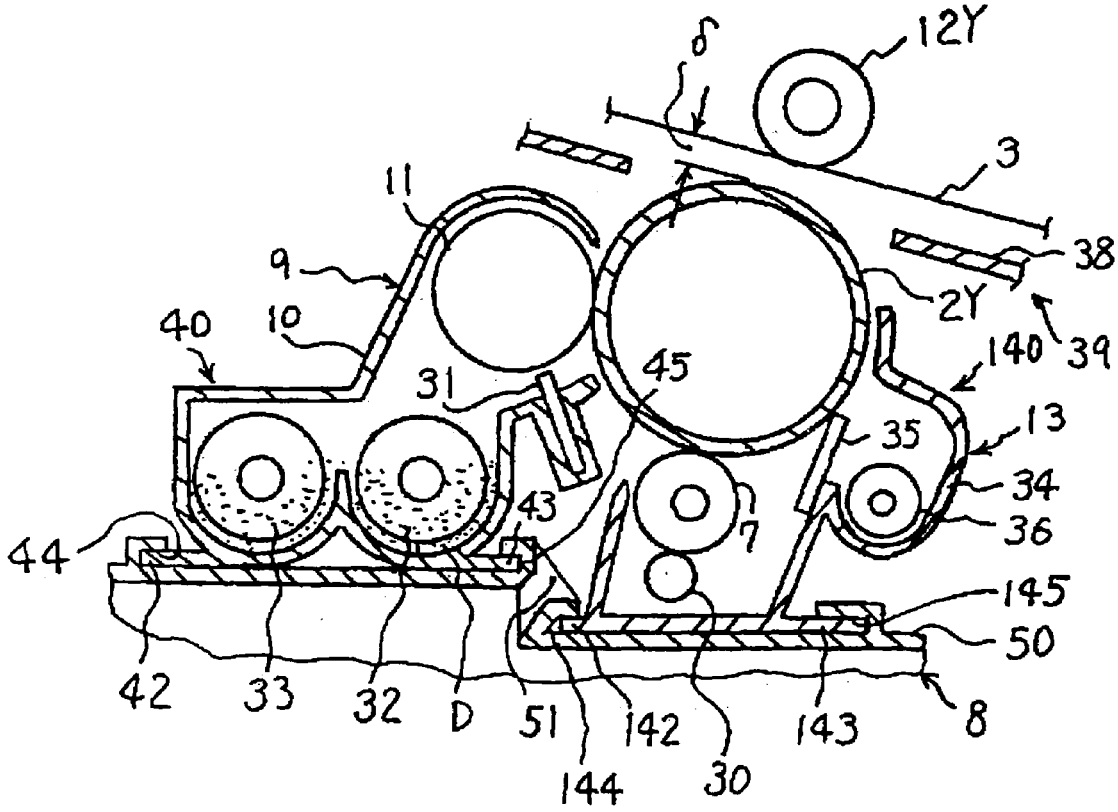
FIG. 31 shows the intermediate image transfer belt in a position released from the first drum.

In light of the above, the illustrative embodiment includes guide means provided on the case 50 of the optical writing unit 8 for guiding the image forming unit to be mounted or dismounted to thereby prevent it from contacting the image transferring unit 39. Specifically, as shown in FIG. 31, the image forming units 40 and 140 are mounted on the top of the case 50. The case 10 of the image forming unit 40 is formed with a pair of substantially horizontal projections 42 and 43 received in guide channels 44 and 45, which are formed in the projections of the case 50. The projections 42 and 43 are respectively slidable in the guide channels 44 and 45, which are elongate in the axial direction of the drum 2Y, i.e., the direction perpendicular to the sheet surface of FIG. 31.

The case 34 of the other image forming unit 140 is also formed with a pair of substantially horizontal projections 142 and 143 slidably received in guide channels 144 and 145 formed in the case 50. The guide channels 144 and 145 are also elongate in the axial direction of the drum 2Y.

As shown in FIG. 31, assume that the operator releases the belt 3 from the drum 2Y and then pulls the image forming unit 40 toward the front in the axial direction of the drum 2Y, i.e., perpendicular to the sheet surface of FIG. 31. Then, the image forming unit 40 moves toward the front while being mounted on the top of the case 50. At this instant, the projections 42 and 43 slide in the guide channels 44 and 45 and prevent the image forming unit 40 from hitting against or rubbing the image transferring unit 39. Stated another way, the guide means, implemented by the guide channels 44 and 45, prevents the image forming unit 40 from moving toward the image transferring unit 39 to thereby maintain the distance between them substantially constant.

Likewise, the developing roller 11 of the image forming unit 40 is prevented from rubbing the drum 2Y with a strong force and scratching it. This is also true when the image forming unit 40 is inserted into the printer body 1 with the projections 44 and 45 sliding in the guide channels 44 and 45, respectively. Also, the projections 142 and 143 of the image forming unit 140, respectively received in the guide channels 144 and 145, allow the unit 140 to be mounted to or dismounted from the printer body 1 without hitting against or rubbing the image transferring unit 39. Further, the drum 2Y is prevented from rubbing the developing roller 11 with a strong force.

The guide means described above allows even the user of the printer to handle the image forming units 40 and 140 without damaging the image transferring unit 39. Should the drum 2Y and belt 3, among others, contact each other during mounting or dismounting of the image forming unit 140Y, the service life of the drum 2Y and that of the belt 3 would be reduced.

Because the guide means surely prevents the image forming unit from contacting the image transferring device, as stated above, it is not necessary to move the belt 3 away from the drum 2Y by a great distance before pulling out the image forming unit. This allows a distance δ, see FIG. 31, between the belt 3 and the drum 2Y to be reduced and therefore prevents the printer body 1 from increasing in size.

Figure 32:
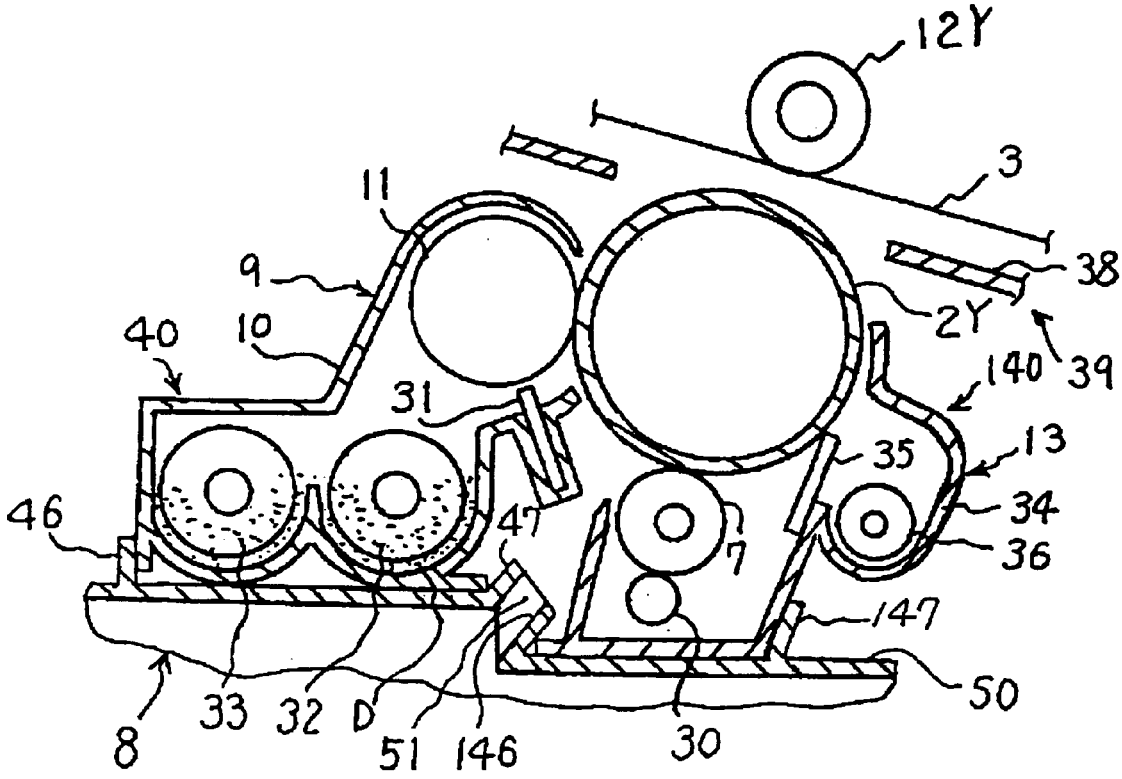
FIG. 32 shows another specific configuration of guide means included in the third embodiment.

FIG. 32 shows another specific configuration of the guide means. As shown, the case 50 is formed with a pair of projections 46 and 47 and another pair of projections 146 and 147 each extending in the axial direction of the drum 2Y. The projections 46 and 47 guide the image forming unit 40 while the projections 147 and 147 guide the other image forming unit 140. This configuration is also successful to prevent the image forming units 40 and 140 from strongly rubbing each other when the units 40 and 140 are mounted or dismounted.

Because the guide means shown in FIGS. 31 and 32 each are provided on the case 50 of the optical writing unit 8, it is not necessary to use an exclusive guide arrangement, which would complicate the structure of the printer and would increase the cost of the printer.

The guide channels 144 and 145, FIG. 31, and guides 47 and 146, FIG. 32, both are implemented by projections formed by bending part of the case 50 of the optical writing unit 8 around an emission aperture 51. This configuration increases the rigidity of part of the case 50 around the emission aperture 51 and therefore prevents the above part from deforming when subject to an extraneous force; otherwise, the laser beam L would be blocked.

The guide means shown in FIG. 31 or 32 may be so configured as to position the image forming unit at a preselected position when the image forming unit is mounted to the printer body, in which case exclusive positioning means, which would increase the cost of the printer, is not necessary. For example, the guide channels 44 and 45 or the projections 46 and 47 may be tapered such that the developing roller 11 of the image forming unit 40 is spaced from the drum 2Y by a relatively great distance at the initial stage of insertion and then approaches the drum 2Y just before the end of insertion. Likewise, the guide channels 144 and 145 or the projections 146 and 147 may be tapered such that the drum 2Y of the other image forming unit 140 is spaced from the belt 3 by a relatively great distance at the initial stage of insertion and then approaches or contacts the belt 3 just before the end of insertion. In the case where the drum 2Y contacts the belt 3 when the image forming unit 140 is set at a preselected position, the arrangement for releasing the belt 3 from the drum stated earlier is not necessary.

Even in the above configuration, the developing roller 11 and drum 2Y respectively approach the drum 2Y and belt 3 just before the image forming units 40 and 140 are fully set in the printer, the developing roller 11 and drum 2Y are prevented from strongly hitting against the drum 2Y and belt 3, respectively.

The guide configuration shown in FIG. 31 or 32 may be applied to the other image forming units relating to the drums 2C, 2M and 2BK as well.

Assume that the image forming unit, including the image carrier and at least one image forming device for forming a toner image on the drum, constitute a so-called process cartridge. Then, the case 10 of the developing unit 9 and the case 34 of the drum cleaner 13 may be constructed into a single unit case with the developing unit 9, drum cleaner 13, charge roller 7 and cleaning roller 30 being mounted on the unit, constituting a process cartridge. In this configuration, too, the guide means surely guides the process cartridge when the process cartridge is mounted or dismounted.

Various modifications will become possible for those skilled in the art after receiving the teachings of the present disclosure without departing from the scope thereof.

What is claimed is:

1. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, the removable member comprising a developing roller configured to deliver toner to the image carrier;

a frame surrounding said surrounding member, the frame being disposed around the surrounding member such that the frame and surrounding member are removable together from the apparatus body as a frame unit; and a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body, the contact member disposed on the removable member such that removal of the removable member from the apparatus body results in a corresponding removal of the contact member from the apparatus body, wherein at least one of said removable member and said surrounding member comprises a belt for supporting either one of an image and a recording medium thereon.

2. The apparatus as claimed in claim 1, wherein said removable member comprises a single unit including a plurality of members.

3. The apparatus as claimed in claim 2, wherein said unit comprises a developing unit constituting said developing device.

4. The apparatus as claimed in claim 2, further comprising a cleaning device configured to remove a developer left on the surface of said image carrier, wherein said unit comprises a cleaning unit constituting said cleaning device.

5. The apparatus as claimed in claim 2, wherein said unit comprises a process cartridge including at least one of a member and a device used for forming an image and said image carrier.

6. The apparatus as claimed in claim 1, wherein said contact member comprises a grip included in said removable member.

7. The apparatus as claimed in claim 1, wherein said removable member comprises a single unit including a plurality of members.

8. The apparatus as claimed in claim 7, wherein said unit comprises a developing unit constituting said developing device.

9. The apparatus as claimed in claim 7, further comprising a cleaning device configured to remove a developer left on the surface of said image carrier, wherein said unit comprises a cleaning unit constituting said cleaning device.

10. The apparatus as claimed in claim 7, wherein said unit comprises a process cartridge including at least one of a member and a device used for forming an image and said image carrier.

11. The apparatus as claimed in claim 7, wherein said contact member comprises a grip included in said removable member.

12. The apparatus as claimed in claim 1, wherein said contact member comprises a grip included in said removable member.

13. The image forming apparatus according to claim 1, wherein the contact member is configured to be disposed on an upper portion of the removable member and is configured to come into contact with a lower surface of the frame.

14. The image forming apparatus according to claim 13, wherein the frame surrounds an upper and a lower portion of the surrounding member, and the surrounding member is configured to receive the toner image from the image carrier.

15. The image forming apparatus according to claim 14, wherein the surrounding member comprises a belt.

16. The image forming apparatus according to claim 1, wherein the removable member is configured to be supported by a casing.

17. The image forming apparatus according to claim 16, wherein the contact member is configured to be disposed on an upper portion of the removable member and is configured to come into contact with a lower surface of the frame.

18. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, wherein said removable member comprises a single unit including a plurality of members, and wherein said surrounding member comprises a belt for supporting either one of an image and a recording medium thereon;

a frame surrounding said surrounding member, the frame being disposed around the surrounding member such that the frame and surrounding member are removable together from the apparatus body as a frame unit;

a contact member configured to contact, when said removable member is being mounted to or dismounted from said apparatus body, said frame to thereby determine a distance between said removable member and said surrounding member, the contact member including at least one contacting face conflaured to be brought into and out of contact with the frame in the apparatus body without changing an orientation of the frame when the removable member is being mounted to or dismounted from the apparatus body; and a shutter member configured to isolate an inside of said unit from an external space when said unit is dismounted from said apparatus body, wherein said contact member comprises said shutter member.

19. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, wherein said surrounding member comprises a belt for supporting either one of an image and a recording medium thereon;

a frame surrounding said surrounding member, the frame being disposed around the surrounding member such that the frame and surrounding member are removable together from the apparatus body as a frame unit; and a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body, wherein said contact member is included in a covering of said removable member.

20. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, wherein said removable member comprises a single unit including a plurality of members;

a frame surrounding said surrounding member, the frame being disposed around the surrounding member such that the frame and surrounding member are removable together from the apparatus body as a frame unit; and a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body, wherein said contact member is included in a covering of said removable member.

21. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, wherein said removable member comprises a single unit including a plurality of members;

a frame surrounding said surrounding member, the frame being disposed around the surrounding member such that the frame and surrounding member are removable together from the apparatus body as a frame unit;

a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body; and a shutter member configured to isolate an inside of said unit from an external space when said unit is dismounted from said apparatus body, wherein said contact member comprises said shutter member.

22. An image forming apparatus comprising:

an apparatus body;

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body;

a frame surrounding said surrounding member, the frame being disposed around the surrounding member such that the frame and surrounding member are removable together from the apparatus body as a frame unit; and a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body, wherein said contact member is included in a covering of said removable member.

23. The apparatus as claimed in claim 22, wherein said contact member comprises a grip included in said removable member.

24. In a process cartridge removably mounted to an apparatus body of an image forming apparatus, said image forming apparatus comprising:

an image carrier configured to carry a latent image on a surface thereof;

a developing device configured to develop the latent image to thereby produce a corresponding toner image;

a removable member removably mounted to said apparatus body and positioned in said apparatus body such that a distance between said removable member and a surrounding member varies when said removable member is being mounted to or dismounted from said apparatus body, the removable member comprising a developing roller configured to deliver toner to the image carrier;

a frame surrounding said surrounding member, the frame being disposed around the surrounding member such that the frame and surrounding member are removable together from the apparatus body as a frame unit; and a contact member configured to contact, when said removable member is being mounted to or dismounted from said apparatus body, said frame to thereby determine a distance between said removable member and said surrounding member, the contact member including at least one contacting face configured to be brought into and out of contact with the frame in the apparatus body without changing an orientation of the frame when the removable member is being mounted to or dismounted from the apparatus body, the contact member disposed on the removable member such that removal of the removable member from the apparatus body results in a corresponding removal of the contact member from the apparatus body, wherein the surrounding member comprises a belt.

25. In the process cartridge according to claim 24, wherein the contact member is configured to be disposed on an upper portion of the removable member and is configured to come into contact with a lower surface of the frame.

26. In the process cartridge according to claim 25, wherein the frame surrounds an upper and a lower portion of the surrounding member, and the surrounding member is configured to receive a toner image from the image carrier.

27. In the process cartridge according to claim 24, wherein the removable member is configured to be supported by a casing.

28. In the process cartridge according to claim 27, wherein the contact member is configured to be disposed on an upper portion of the removable member and is configured to come into contact with a lower surface of the frame.

* * * * *